US010967628B2

(12) United States Patent
Zou

(10) Patent No.: US 10,967,628 B2
(45) Date of Patent: Apr. 6, 2021

(54) ENERGY-SAVING ENVIRONMENT-FRIENDLY DIGITAL LETTERING MACHINE

(71) Applicant: SHENZHEN REBORN PRECISION MACHINERY CO., LTD., Guangdong (CN)

(72) Inventor: Ping Zou, Guangdong (CN)

(73) Assignee: SHENZHEN REBORN PRECISION MACHINERY CO., LTD., Shenzhen (CN)

( * ) Notice: Subject to any disclaimer, the term of this patent is extended or adjusted under 35 U.S.C. 154(b) by 0 days.

(21) Appl. No.: 16/799,830

(22) Filed: Feb. 25, 2020

(65) Prior Publication Data

US 2020/0238682 A1 Jul. 30, 2020

Related U.S. Application Data

(63) Continuation of application No. PCT/CN2019/081694, filed on Apr. 8, 2019.

(30) Foreign Application Priority Data

Jan. 30, 2019 (CN) ..... 201910090007.X

(51) Int. Cl.
*B41F 1/22* (2006.01)

(52) U.S. Cl.
CPC ..... *B41F 1/22* (2013.01)

(58) Field of Classification Search
None
See application file for complete search history.

(56) References Cited

U.S. PATENT DOCUMENTS 2,757,728 A * 8/1956 De Lisi ..... B26F 1/42 83/13
9,927,802 B2 * 3/2018 Nagai ..... G05B 19/4097
2017/0011286 A1 * 1/2017 Kouguchi ..... G06K 15/1868

FOREIGN PATENT DOCUMENTS

CN 202264581 U 6/2012
CN 103406929 A 11/2013
CN 104552450 A 4/2015
CN 207058704 U 3/2018

* cited by examiner

*Primary Examiner* — Alejandro Valencia

(57) ABSTRACT

An energy-saving environment-friendly digital lettering machine comprises a conveying mechanism, a rewinding mechanism and a machine base, wherein the machine base is provided with a working platform, and the conveying mechanism and the rewinding mechanism are respectively arranged on the left side and the right side of the working platform; the lettering machine further comprise a lettering mechanism, the working platform is provided with at least one lettering mechanism, and each lettering mechanism is arranged on the working platform through a corresponding mounting base, wherein the conveying mechanism, the lettering mechanism and the rewinding mechanism are all electrically connected with a control system of the lettering machine. This equipment combines the X-axis moving assembly and the Z-axis moving assembly with the lettering assembly, the lettering assembly can move in the horizontal direction and the vertical direction, and the lettering cutter engraves patterns on the material part.

40 Claims, 27 Drawing Sheets

ENERGY-SAVING ENVIRONMENT-FRIENDLY DIGITAL LETTERING MACHINE

CROSS REFERENCE TO RELATED APPLICATIONS

The present application is a Continuation Application of PCT Application No. PCT/CN2019/081694 filed on Apr. 8, 2019, which claims the benefit of Chinese Patent Application No. 201910090007.X filed on Jan. 30, 2019. All the above are hereby incorporated by reference.

TECHNICAL FIELD

The invention relates to the field of die cutting machines, in particular to a lettering machine for replacing the die cutting machine to process the material part.

BACKGROUND

The die cutting machine, which is also called beer machine, cutting machine and CNC punching machine, is mainly used for die cutting (full-break and half-break), indentation and gold stamping operation, lamination and automatic waste discharge of some corresponding non-metallic materials, adhesive stickers, EVA, double faced adhesive tapes, electronic and mobile phone rubber mats and the like, wherein the die cutting machine applies certain pressure through a stamping plate by using a steel knife, a metal mold or a steel wire (or a stencil engraved from a steel plate), and roll and cut a printed product or a paperboard into a certain shape, therefore the die cutting machine is an important equipment for packaging, processing and forming after printing. The main parts of the die cutting machine are a die cutting platen and a press cutting mechanism, wherein the working principle of the die cutting machine is as follows: the die cutting work is finished under the action of pressure, in short, the die cutting pressure is generated by the pressing of the movable platform and the upper fixed platform.

The prior art discloses a die cutting machine (application number: 201720826920.8), and the die cutting machine according to the utility model includes a feeding portion, a die cutting portion and a material receiving portion, wherein the die cutting portion includes a base and a briquetting, a coupling mechanism is provided between the briquetting and the base, the coupling mechanism is provided with an adjusting module which is used to adjust the interval distance between the briquetting and the base, so that the interval distance between the base and the briquetting is able to be effectively adjusted through adjustment of the adjusting module, therefore the die cutting machine is enable to satisfy the needs of different die cutting products. According to the needs of different products, the knife molds of different models or sizes can be replaced, which further expands the application scope of the die cutting machine, and makes the die cutting machine be better adapted to the cutting of different products.

The above mentioned die cutting machine is consistent with the existing die cutting machine, which is to make the printed matters or other paper products into a die cutting stencil for cutting according to a pre-designed pattern, so that the shape of the printed matters is no longer limited to straight edges and right angles. The die cutting tools for traditional die cutting production are combined into the die cutting stencil according to the pattern required by the product design, and the printed matters or other plate-shaped blanks are rolled and cut into required shapes or cutting marks under the action of pressure.

The prior art further discloses a die cutting mechanism (application number: 201410857534.6) for a web compound die cutting machine, which comprises a die cutting frame, wherein a die cutting tool magazine is mounted on the top of the die cutting frame, an upper die cutting platform and a lower die cutting platform are mounted in the die cutting frame, and one side edge of the die cutting frame is equipped with a paper pulling upper roller and a paper pulling lower roller which are arranged in a rolling manner. A paper beating device is mounted on the other side edge of the die cutting machine frame. The die cutting tool magazine is used for mounting die cutting tools of various specifications, so that the die cutting tools are convenient to replace.

However, each time the traditional die cutting machine processes a product, it needs to make a matched corresponding die cutting tool, then load the die cutting tool in the die cutting machine upper stencil through a double-sided adhesive tape or a clamping position, and place a film below the die cutting machine upper stencil, and then manually adjust the punching size thereof, so that a large amount of manpower is consumed, a large amount of debugging materials are wasted, a large amount of waste products are generated, and the waste of resources is not beneficial to environmental protection; and this kind of debugging mode completely depends on the technical level of debugging personnel, it takes a large amount of time to produce matched die cutting tools and debug the machine before the material part are formally processed, so that the working efficiency is reduced.

Further, in the process of producing the die cutting tool, each die cutting tool needs to use a corresponding PVC board or wood as the fixed frame of the cutting tool, so that a large amount of PVC boards and wood are wasted. Meanwhile, in the production and processing process of PVC board and wood, it will also lead to a large number of waste water, waste gas and noise, which is not conducive to environmental protection.

The service life of the common die cutting tool is usually between hundreds of thousands of lathing and millions of lathing, making die cutting tool will also generate corresponding cost, and debugging the machine also needs to waste a certain amount of material parts, therefor the production cost is high, the die cutting tool is not suitable for small-batch production, and the production efficiency is reduced.

SUMMARY

In view of the defects in the above technology, the object of the invention is to provide an energy-saving environment-friendly digital lettering machine, which applies the technical idea of lettering technology into the field of die cutting machines. It is not needed to produce matched die cutting tool before processing each product, and it is only needed to introduce the pattern files required to be produced into a control system, and utilize the combination of a lettering mechanism and the control system to enable the lettering cutters to engrave patterns on material part, so that the needs of producing products with variable contents under the actual conditions can be met, and the production cost is reduced.

Another object of the invention is to provide an energy-saving environment-friendly digital lettering machine, by using the equipment, the links of the die cutting tool production and debugging the machine are omitted, the generation of waste products is reduced, the energy is saved and environmental protection is facilitated; and the equipment has high automation degree, simple operation, quick stencil change and good use effect, and is suitable for the production requirement of small batch.

In order to achieve the above object, the present invention is achieved as follows:

An energy-saving environment-friendly digital lettering machine, which comprises a conveying mechanism, a rewinding mechanism and a machine base, wherein the machine base is provided with a working platform, and the conveying mechanism and the rewinding mechanism are respectively arranged on the left side and the right side of the working platform, is characterized in that the lettering machine further comprise a lettering mechanism, the working platform is provided with at least one lettering mechanism and a mounting base, and each lettering mechanism is arranged on the working platform through the corresponding mounting base, wherein the conveying mechanism, the lettering mechanism and the rewinding mechanism are all electrically connected with a control system of the lettering machine; each lettering mechanism comprises a lettering assembly, an X-axis moving assembly and a Z-axis moving assembly, wherein the lettering assembly realizes the engraving of patterns, and the lettering assembly is arranged on the X-axis moving assembly and supported by the Z-axis moving assembly.

In the present application, in the horizontal plane, the direction perpendicular to the conveying direction of the material part is the X-axis direction, and the conveying direction of the material part is the Y-axis direction, and the vertical direction is the Z-axis direction. Wherein, the lettering route of the lettering machine can be realized by the existing programming, the software part is not the protection scope of the invention, and the invention only illustrates the improvement of the product structure. The pattern files required to be produced are introduced into the control system, the control system controls the conveying mechanism to convey the material part to the lettering mechanism, wherein the conveying mechanism can realize the forward and backward movement of the material part, thereby controlling the movement of the material part in the Y-axis direction, which is matched with the movement of the lettering assembly in the X-axis and Z-axis directions, the X-axis moving assembly controls the Z-axis moving assembly and the lettering assembly to slide in the X-axis direction, the Z-axis moving assembly controls the lettering assembly to ascend and descend in the Z-axis direction, thereby controlling the lettering depth of the material part by the lettering assembly and further controlling the lettering assembly to engrave various patterns of the material part, and the rewinding mechanism receives and discharges the processed material part to meet the production requirement; meanwhile, the feeding direction of the existing conveying mechanism is used as a movement control direction of the lettering assembly, so that the mechanism of the existing lettering machine can be fully utilized, the mechanism setting is simplified, and the manufacturing cost is reduced.

Further, each lettering mechanism comprises a lettering assembly, an X-axis moving assembly and a Z-axis moving assembly, wherein the lettering assembly is fixedly arranged on the Z-axis moving assembly, the lettering assembly slides up and down on the Z-axis moving assembly, the Z-axis moving assembly is fixedly arranged on the X-axis moving assembly, and the Z-axis moving assembly and the lettering assembly slide together on the X-axis moving assembly.

Further, the mounting base and the X-axis moving assembly are fixedly connected, the mounting base is provided with a channel for conveying the material part, and the mounting base includes a first mounting portion and a second mounting portion, wherein the first mounting portion is connected to the second mounting portion at a certain angle to form an L-shaped structure, and a tool bit base adapted to the lettering assembly is provided on the second mounting portion.

Further, when the number of the lettering mechanism is set to be one, the lettering mechanism is fixedly provided on the working platform through the corresponding mounting base, or the lettering mechanism is slidably connected with the working platform through a sliding assembly.

Further, when the number of the lettering mechanisms is set to be two or more, at least one lettering mechanism is fixed on the working platform, and at least one lettering mechanism is slidably connected with the working platform through a sliding assembly, and each lettering mechanisms is arranged side by side in the Y-axis direction.

Further, when the number of the lettering mechanisms is set to be two or more, the lettering mechanisms are all movably arranged on the working platform through a sliding assembly, and each lettering mechanism is arranged side by side in the Y-axis direction.

Further, when the number of the lettering mechanisms is set to be two or more, the lettering mechanisms are fixedly arranged on the working platform, and each lettering mechanism is arranged side by side in the Y-axis direction.

When the number of the lettering mechanisms is two or more, each lettering mechanism indirectly processes the material part, the part where the former lettering mechanism does not process is processed by the latter lettering mechanism, and the plurality of lettering mechanisms cooperate with each other, so that lettering can be completed on the whole coil material part, and the lettering efficiency can be further improved.

Further, the sliding assembly is arranged on the working platform, the sliding assembly is electrically connected with the control system, and the sliding assembly comprises a sliding base and a first driving unit, wherein the sliding base is connected with the first driving unit, and the sliding base is fixedly connected with the mounting base.

Still further, the first driving unit comprises a first screw rod and a first motor, the bottom of the sliding base is provided with a nut connecting seat which is sleeved on the first screw rod, and the first screw rod is connected with the first motor. The control system drives the first screw rod to rotate by using the first motor, and the first screw rod drives the sliding base to slide on the first screw rod through the nut connecting seat, so as to drive the mounting base and the second lettering mechanism to slide on the working platform. In case of using the combination of the motor and the screw rod to control the movement of the sliding base on the working platform, the structure is simple and easy to control.

Further, the X-axis moving assembly is a linear motor which comprises a motor body and a rotor seat sliding on the motor body, and the rotor seat is fixedly connected with the Z-axis moving assembly. The linear motor is a prior art, preferably, the linear motor uses an absolute value encoder, which utilizes the characteristic of the absolute value encoder, namely the absolute value encoder determines encoding according to a mechanical position, so that the anti-interference characteristic and the data reliability of the absolute value encoder are greatly improved.

Further, the X-axis moving assembly comprises a first base, a second driving unit and a first sliding plate, wherein the second driving unit and the first sliding plate are both arranged on the first base, the first base is fixedly connected with the mounting base, the first base is provided with a first sliding rail for the first sliding plate to slide, the first sliding plate is fixedly connected with the Z-axis moving assembly, and the first sliding plate is connected with the second driving unit. The second driving unit drives the first sliding plate to move in the X-axis direction along the first sliding rail, and further drives the Z-axis moving assembly on the first sliding plate to slide in the X-axis direction.

Further, the shortest edge of the first sliding plate is vertically arranged on the mounting base, the second driving unit comprises a second motor and a second screw rod, the second motor is connected with the second screw rod, and the second screw rod is slidably connected with the first sliding plate. Preferably, the second motor uses an absolute value encoder, which is a prior art. Compared with the horizontal arrangement of the first base, when the first base is vertically arranged, the occupied area of the first base can be greatly reduced, namely the mounting area of the X-axis moving assembly on the working platform is reduced, thereby facilitating the arrangement of the plurality of lettering mechanisms on the working platform, and simultaneously facilitating the decreasement of the occupied area of the lettering machine.

Further, the Z-axis moving assembly comprises a second base, a third motor and a third screw rod, wherein the third motor and the third screw rod are arranged on the second base, the second base is provided with a second sliding rail, the third screw rod and the second sliding rail are arranged in parallel in the vertical direction, the third screw rod and the third motor are connected, the second base is fixedly connected with the X-axis assembly, and the third screw rod and the second sliding rail are slidably connected with the lettering assembly. Preferably, the third motor also adopts an absolute value encoder in the prior art, the third screw rod is driven to rotate by the third motor, and the third screw rod rotates to drive the lettering assembly to move up and down along the second sliding rail in the Z-axis direction.

Further, the second base is provided with a plurality of lifting buffer springs, one end of each lifting buffer spring is fixedly connected with the second base, and the other end of each lifting buffer spring is fixedly connected with the lettering assembly. In the up-and-down lifting process of the lettering assembly, the setting of the lifting buffer spring can play a role in buffer, so that the speed of the lettering assembly in ascending and descending is prevented from being too fast, the load of the third motor is reduced, and the lifting buffer spring can help to support a part of weight when the lettering assembly moves.

Further, the second base is further provided with a color mark sensor, and the color mark sensor is electrically connected with the control system. The color mark sensor is a prior art, and is used for searching for pattern MARK points on the edge of the material part, and transmitting the signal to the control system for processing, so that the control system can control the lettering assembly to carry out lettering operation on the material part.

Further, the lettering assembly comprises a third base and one or more tool aprons, wherein the third base is slidably connected with the Z-axis moving assembly, the tool apron is arranged on the third base, the tool apron is provided with a cutting tool which is corresponding to the tool bit base on the mounting base. The cutting tool is a prior art, and the specific model of the cutting tool can be CB09UA-5 CB09U.

Further, the third base is provided with a third sliding rail which is horizontally arranged along the X-axis direction, when the third base is provided with two or more tool aprons, at least one tool apron is arranged on the third sliding rail, and each tool apron arranged on the third sliding rail is connected with a fourth screw rod and a fourth motor which correspond to the tool apron. When the third base is provided with two or more tool aprons, the tool aprons arranged on the third sliding rail are all connected to the fourth screw rod and the fourth motor which correspond to the tool aprons, so that the fourth motor drives the tool aprons to slide in the horizontal direction along the fourth screw rod and the third sliding rail, and the distance between the multiple tool aprons can be adjusted to adapt to the lettering pattern of the material part, meanwhile, the processing efficiency of the lettering assembly is further improved.

Further, the conveying mechanism comprises a paper feeding assembly and paper pulling assemblies, wherein the paper feeding assembly is arranged on the left side of the working platform, both ends of the working platform are provided with the paper pulling assembly, the paper feeding assembly conveys the material part to the paper pulling assemblies after unwinding the material part, the paper pulling assemblies convey the material part to the working platform and convey the lettered material part to the rewinding mechanism. When the lettering mechanism is arranged on the working platform, the paper pulling assemblies at the two ends of the working platform can be utilized to simultaneously rotate forwards and backwards to realize the forward and backward movement of the material part, namely the movement of the material part in the Y-axis direction of the lettering position.

Further, the paper feeding assembly comprises a paper feeding base, a material feeding shaft and a paper pulling roller, wherein the material feeding shaft and the paper pulling roller are both arranged on the paper feeding base, and the material feeding shaft and the paper pulling roller are sequentially arranged to form a paper feeding path through which a material part passes.

Further, the paper feeding base is further provided with a deviation rectifying assembly which is arranged between the material feeding shaft and the paper pulling roller, and the deviation rectifying assembly includes a deviation rectifying base, a paper guiding frame, a deviation rectifying motor and a deviation electric eye, wherein the deviation rectifying base is fixed on the paper feeding base, the deviation rectifying motor and the deviation electric eye are both fixed on the deviation rectifying base, the paper guiding frame is connected with the deviation rectifying motor, the straight line where the output shaft of the deviation rectifying motor is located is perpendicular to the straight line where the axis of the paper guiding frame is located, the deviation electric eye senses the deviation signal of the material part, and the deviation electric eye and the deviation rectifying motor are both electrically connected with the control system. The deviation rectifying assembly is a prior art, and can adopt the existing traveling deviation rectifying device, and the deviation rectifying assembly provides the required deviation rectifying control, and helps the production line to operate effectively and efficiently.

Further, the paper pulling assembly includes a paper pulling side plate, a main paper pulling roller and two paper pulling compression roller units, wherein the main paper pulling roller and the paper pulling compression roller units are all fixed on the working platform through the paper pulling side plate, and the paper pulling compression roller units are movably connected with the main paper pulling roller. The paper pulling assemblies are correspondingly arranged on two sides of the working platform, when the material part is conveyed to the lettering position on the tool bit base, the lettering assembly letters the conveyed material part, and the main paper pulling rollers on the two sides simultaneously rotate forwards and backwards to control the material part to move left and right in the lettering position, namely, the main paper pulling rollers can realize the forward and backward movement of the material part, and control the movement of the material part in the Y-axis direction, which is matched with the movement of the lettering assembly in the X-axis and Z-axis directions to realize the lettering of complex patterns on the material part.

Further, the paper pulling compression roller unit includes a paper compression roller, paper compression sliders, cylinders and cylinder clamping blocks, wherein both ends of the paper compression roller are provided with the paper compression slider, the cylinder and the cylinder clamping block, the paper pulling side plate is provided with a supporting groove adapted to the paper compression slider, the paper compression sliders are slidably connected with the paper pulling side plate, the cylinders are fixedly connected with the cylinder clamping blocks, the cylinder clamping blocks are fixed at the two ends of the paper compression roller, and the peripheral surface of the paper compression roller is tightly attached to the peripheral surface of the main paper pulling roller and forms the conveying path of the material part. When the cylinders drive the cylinder clamping blocks to extend out, the paper compression sliders are driven to slide in the supporting groove, and the paper compression roller is further driven to push toward the main paper pulling roller, so that the paper compression roller and the main paper pulling roller are pressed tightly; when the cylinders drive the cylinder clamping blocks to retract, the paper compression roller is separated from the main paper pulling roller.

Further, the conveying mechanism further comprises a tension bellows used for tensioning the material part, wherein the tension bellows is electrically connected with the control system, and the tension bellows is arranged between the paper feeding assembly and the paper pulling assembly and/or between the paper pulling assembly and the rewinding mechanism.

Further, the tension bellows comprises a fan and a bellows body, wherein the bottom of the bellows body is provided with a wind gap, the fan is communicated with the bellows body through the wind gap, the opening of the bellows body faces upwards and both the left and right sides at the top are provided with a bellows paper guiding roller that is used for the material part to pass into and out of the bellows body, and the bellows body is provided with a height sensor that is used for sensing to the height of the material part. When using the tension bellows, the material part enters the interior from one side of the bellows body and then comes out from the other side, and when the material part is in the interior of the tension bellows, the fan acts on the bellows body to pump out the lower air enclosed by the material part and the bellows body, new air is compensated from the gap position to form air flow, and the material part can be tightened by the air flow formed by the fact that the air pressure at the upper part of the material part is larger than that at the lower part of the material part. The height sensor is a prior art, and specifically, a high-position sensor and a low-position sensor can be arranged on the bellows body, the position of the material part is sensed through the height sensor, a signal is correspondingly sent to the control system, and the control system controls the feeding or discharging operation of the tension bellows.

Further, the bellows paper guiding roller on each side is sleeved with two bellows sliding plates, the material part passes through the bellows paper guiding roller and is limited between the bellows sliding plates on each side, the bellows sliding plates are slidably connected with the bellows paper guiding roller, and each bellows sliding plate is provided with corresponding fastening bolts. The bellows sliding plates are sleeved on the bellows paper guiding rollers, and the distance between the bellows sliding plates on each side can be adjusted by using the fastening bolts, so that the bellows sliding plates can be fixed without sliding when in use, material part cannot be clamped and damaged, and the widths of different material part can be adapted.

Further, the conveying mechanism further comprises a paper feeding mechanism for tightening the material part, the paper feeding mechanism is electrically connected with the control system, and is arranged between the paper feeding assembly and the paper pulling assembly and/or between the paper pulling assembly and the rewinding mechanism. The paper feeding assembly is used for replacing the tension bellows to tighten the material part, so that the noise generated in the production process can be reduced, and the harm of the noise to the health of operators is reduced.

Further, the paper feeding mechanism includes a front side plate, a rear side plate, a first paper guiding roller, a second paper guiding roller, a third paper guiding roller, first buffer sliding bases and a buffer driving assembly, wherein the first buffer sliding bases are connected to the buffer driving assembly, the first paper guiding roller and the second paper guiding roller are both fixed on the upper portions of the front side plate and the rear side plate, both the lower portion of the front side plate and the lower portion of the rear side plate are provided with the first buffer sliding base, the two ends of the third paper guiding roller are respectively slidably connected to the front side plate and the rear side plate through the first buffer sliding bases, and the first paper guiding roller, the third paper guiding roller and the second paper guiding roller sequentially form a conveying channel of the material path. The paper feeding mechanism is arranged between the paper feeding assembly and the paper pulling assembly and/or between the paper pulling assembly and the rewinding mechanism, the paper feeding mechanisms on the two positions are symmetrically arranged, and the buffer driving assembly controls the first buffer sliding bases to slide up and down along the front side plate and the rear side plate to drive the third paper guiding roller to move up and down, the first buffer sliding base and the third paper guiding roller move up along with the consumption of the material part, and the first buffer sliding base and the third paper guiding roller move down along with the supplement of the material part, and the material part passing through the third paper guiding roller is in a tensioned state by the up and down movement of the third paper guiding roller.

Further, the front side plate and the rear side plate are fixedly provided with at least one position sensor for sensing the positions of the first buffer sliding bases, and the position sensors are electrically connected to the control system. The position sensors are known in the art and may be linear displacement sensors or other sensors. Specifically, each first buffer sliding base is provided with a vertical sensing piece which is adapted to one position sensor, so that the sensing piece on each first buffer sliding base can be ascended or descended within the sensing range of the position sensor, which is beneficial to controlling the conveying speed of the material part, and effectively prevents the material from being damaged due to the excessive descending or ascending of the first buffer sliding bases.

Further, the buffer driving assembly includes a buffer motor, a first transmission shaft, a second transmission shaft, a synchronizing belt and synchronizing wheels, wherein both ends of the first transmission shaft and both ends of the second transmission shaft are provided with the synchronizing wheels, the buffer motor is connected with the first transmission shaft, the two ends of the first transmission shaft are respectively fixed in the upper portion of the front side plate and the upper portion of the rear side plate, the two ends of the second transmission shaft are respectively fixed in the lower portion of the front side plate and the lower portion of the rear side plate, the synchronizing wheel of the first transmission shaft and the synchronizing wheel of the second transmission shaft on the same side are connected through the synchronizing belt, and the first buffer sliding bases are fixedly connected with the synchronizing belt. The buffer motor drives the first transmission shaft to rotate forward and backward, and the synchronizing belt rotates to drive the first buffer sliding base to ascend or descend, so as to drive the third paper guiding roller to ascend or descend, thereby performing a paper feeding operation.

Further, the buffer driving assembly includes first extension springs, anti-collision blocks and first linear guiding rails, both the inner side of the front side plate and the inner side of the rear side plate are provided the first linear guiding rail, the first linear guiding rails are arranged in the vertical direction, the ends of the first linear guiding rails are provided the anti-collision blocks, one end of each first extension spring is fixedly arranged on one first buffer sliding base, the other end of the first extension spring is fixedly arranged on the front side plate or the rear side plate, and the first buffer sliding bases move up and down along the first linear guiding rails. By providing the first linear guiding rails, the first buffer sliding bases and the third paper guiding roller slide up and down, the third paper guiding roller is constantly subjected to the urging force of the first tension springs, the material part is kept in a tensioned state, and the anti-collision blocks can have anti-collision and limiting effect on the third paper guiding roller.

Further, each first buffer sliding base is further provided with a fourth paper guiding roller for strengthening the tension of the material part and increasing the paper feeding length, wherein the fourth paper guiding roller and the third paper guiding roller are on the same horizontal line, and the upper portion of the front side plate and the upper portion of the rear side plate are further provided with a fifth paper guiding roller, and the first paper guiding roller, the third paper guiding roller, the second paper guiding roller, the fourth paper guiding roller and the fifth paper guiding roller are sequentially arranged to form a paper feeding path through which the material part passes. The fourth paper guiding roller and the third paper guiding roller slide synchronously, which increases the tightening operation of the material part, enhances the tightening state of the material part, and reduces the generation of defective products.

Further, the paper feeding mechanism further includes a buffer assembly which is fixed on the top of the front side plate and the top of the rear side plate, the buffer assembly includes buffer sliders, a buffer sliding unit and a buffer paper guiding roller, both ends of the buffer paper guiding roller are fixedly provided with the buffer slider, the buffer sliding unit is connected with the buffer sliders, and the buffer sliding unit drives the buffer paper guiding roller to move left and right through the buffer sliders.

Further, the buffer sliding unit comprises second linear guiding rails and a second extension spring, wherein the front side plate and the rear side plate are both provided with the second linear guiding rail, the second linear guiding rails are horizontally arranged along the Y-axis direction, the buffer sliders are arranged on the guiding rail sliders of the second linear guiding rails, one end of the second extension spring is fixedly connected with the buffer sliders, and the other end of the second extension spring is fixedly connected with the front side plate or the rear side plate.

Further, the buffer sliding unit comprises buffer guiding shafts, linear bearings and a buffer compression spring, wherein the front side plate and the rear side plate are both provided with the buffer guiding shaft, the buffer guiding shafts are horizontally arranged along the Y-axis direction, the buffer sliders are sleeved on the buffer guiding shafts through the linear bearings, one end of the buffer compression spring is fixedly connected with the buffer sliders, and the other end of the buffer compression spring is abutted against the front side plate or the rear side plate. Specifically, the two ends of the buffer guiding shafts can be arranged on the front side plate or the rear side plate in a fixing block mode, and the other end of the buffer compression spring is correspondingly abutted against the joint of the buffer guiding shaft and the fixing block. Compared with the combination mode of the second linear guiding rail and it own guiding rail slider, the combination mode of the linear bearing and the buffer guiding shaft has the advantages that the contact area of the ball of the linear bearing and the buffer guiding shaft is small, and the movement process is more flexible.

The tops of the front side plate and the rear side plate are provided with a buffer assembly, and the buffer paper guiding roller moves left and right in the horizontal direction to adjust the vertical lifting speed of the first buffer sliding base, thereby adjusting the material part conveying speed and the tension of the material part. Specifically, when the buffer paper guiding roller moves slowly rightward, the first buffer sliding bases also move slowly upward, and when the buffer paper guiding roller moves to the rightmost end, the first buffer sliding bases move up at the fastest speed; when the buffer paper guiding roller moves slowly leftward, the first buffer sliding bases also move slowly downward, and when the buffer paper guiding roller moves to the leftmost end, the first buffer sliding bases move down at the fastest speed.

Further, the rewinding mechanism includes a rewinding base, a stripping assembly, a waste collecting shaft, and a material collecting shaft, wherein the stripping assembly, the waste collecting shaft, and the material collecting shaft are all arranged on the rewinding base, the stripping assembly includes a first stripping roller and a second stripping roller, the second stripping roller is arranged above the first stripping roller, the peripheral surface of the second stripping roller is tightly attached to the peripheral surface of the first stripping roller, and the finished product is wound on the material collecting shaft and the waste product is wound on the waste collecting shaft after the material part passing through the stripping assembly. The processed material part is separated into a product and a waste product through the stripping assembly, and the product and the waste product are automatically respectively would up and cleaned up by using the setting of the material collecting shaft and the waste collecting shaft, so that the lettering processing efficiency is improved.

Further, the rewinding base is provided with a paper cutting traction assembly which is arranged on the right side of the rewinding base, wherein the paper cutting traction assembly comprises a traction roller, a traction roller compression roller and a paper cutting assembly, the peripheral surface of the traction roller is tightly attached to the peripheral surface of the traction roller compression roller, and a material part conveying path is formed between the traction roller and the traction roller compression roller and used for conveying the material part into the paper cutting assembly. Specifically, the paper cutting assembly is a prior art paper cutter, and the paper cutting operation can be achieved by pulling the material part into the paper cutter by the traction roller. When the material part after lettering does not need to be transversely cut off, the finished product and the waste product of the material part can be collected in a rewinding way by utilizing the material collecting shaft and the waste collecting shaft; when the material part after lettering needs to be transversely cut off, the combination of the waste collecting shaft and the traction roller can be utilized to pull the finished product part into the paper cutting assembly, namely the transverse cutting of the finished product is finished.

The invention has the advantages that the equipment combines the X-axis moving assembly, the Z-axis moving assembly and the lettering assembly, and the lettering assembly can move in the horizontal and vertical directions, so that the lettering cutting tool can engrave out the patterns on the material parts, the production of products with variable contents under actual conditions can be met without replacing the die cutting tool, and the production cost is reduced.

By using the equipment, the links of die cutting tool production and debugging machines are omitted, the generation of waste products is reduced, the energy is saved, and the environmental protection is facilitated; and the equipment has high automation degree, simple operation, quick stencil change and good use effect, and is suitable for the production requirement of small batch.

DETAILED DESCRIPTION OF THE INVENTION

Figure 1:
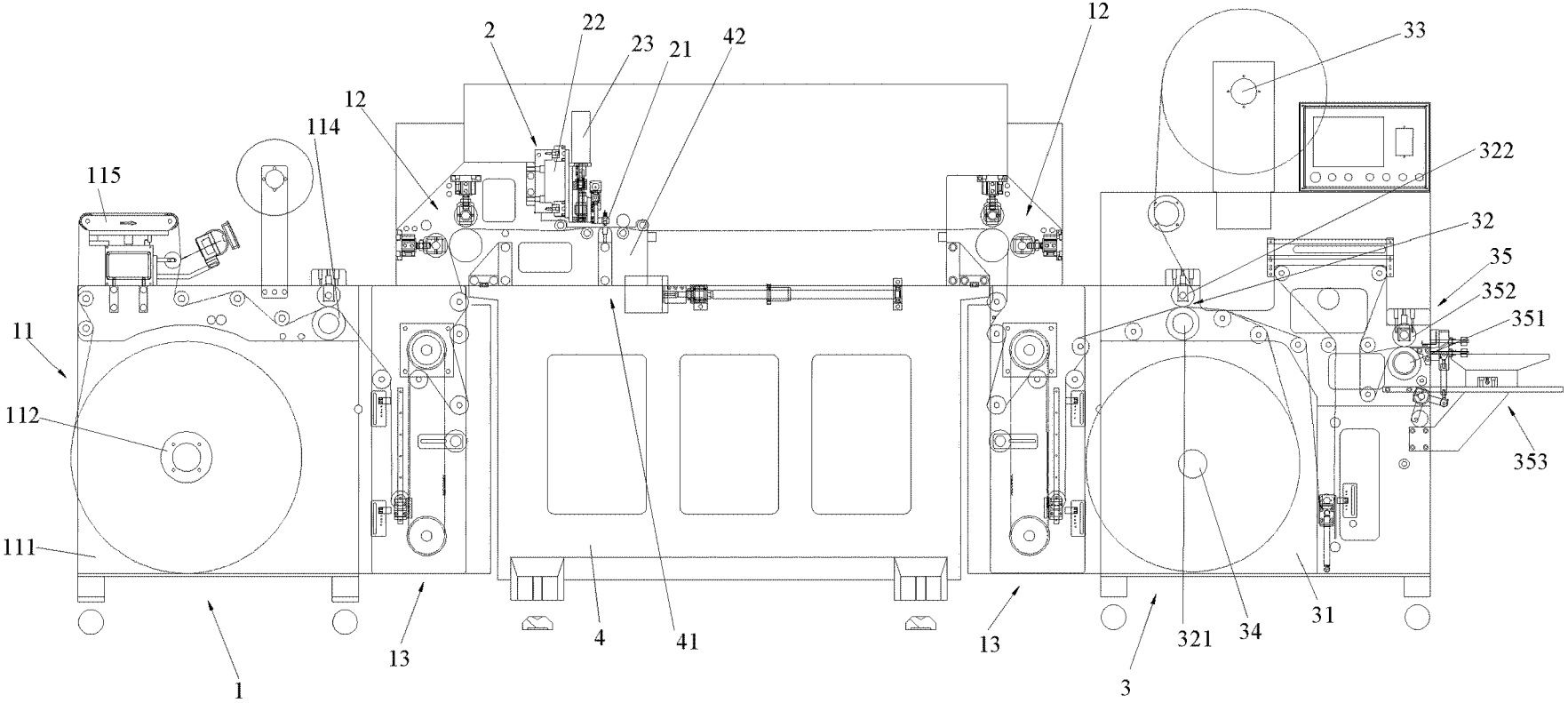
FIG. 1 is a main view of the lettering machine in the first embodiment of the present invention.
Figure 2:
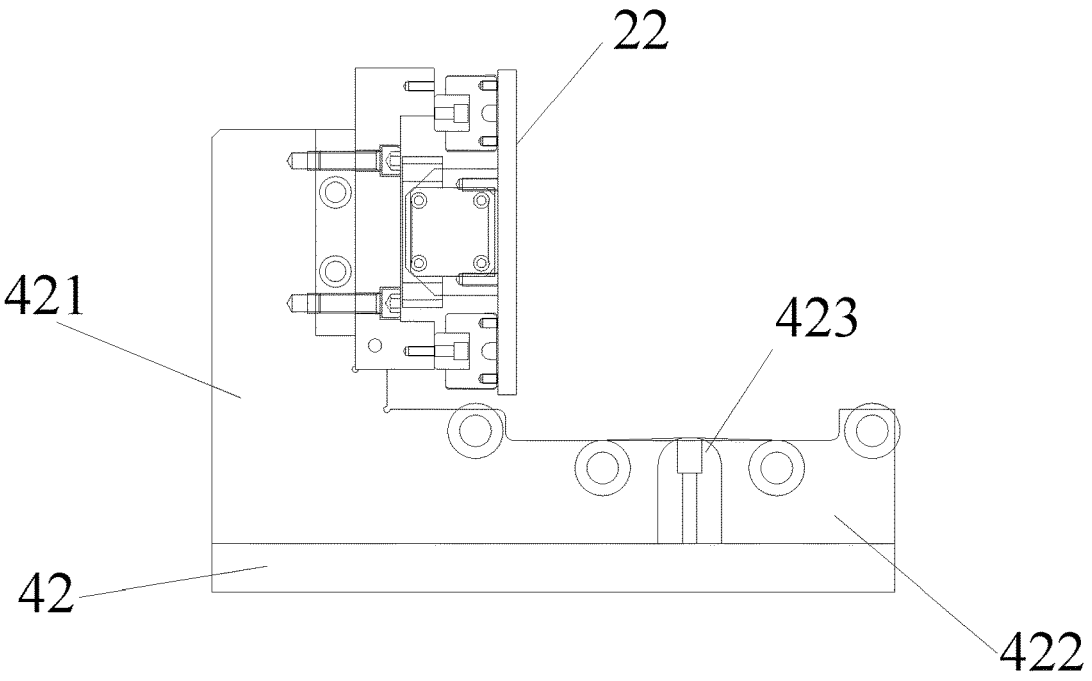
FIG. 2 is a main view of the connection of the mounting base and the X-axis moving assembly in the first embodiment of the present invention.
Figure 3:
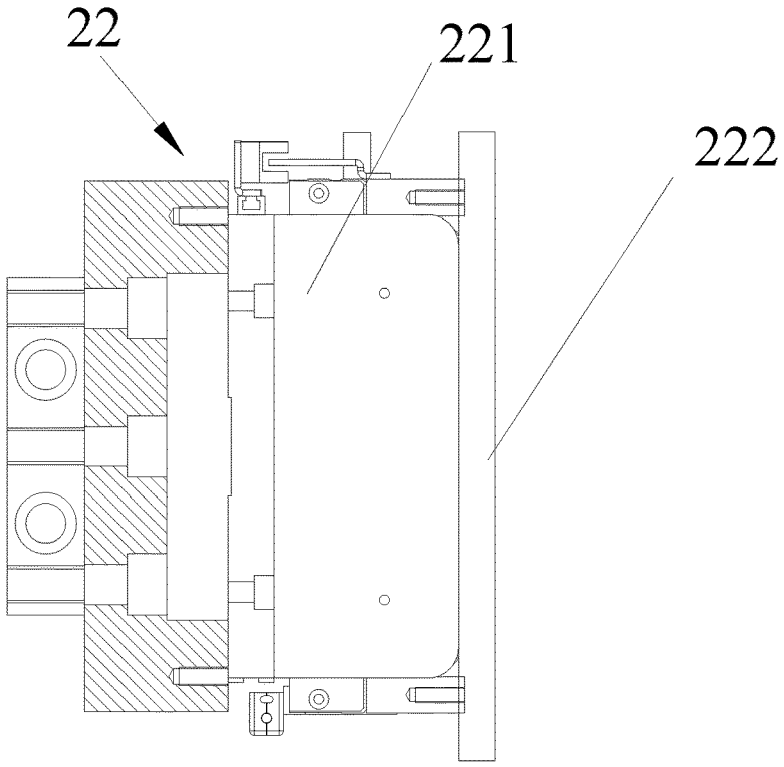
FIG. 3 is a main view of the X-axis moving assembly in the first embodiment of the present invention.
Figure 4:
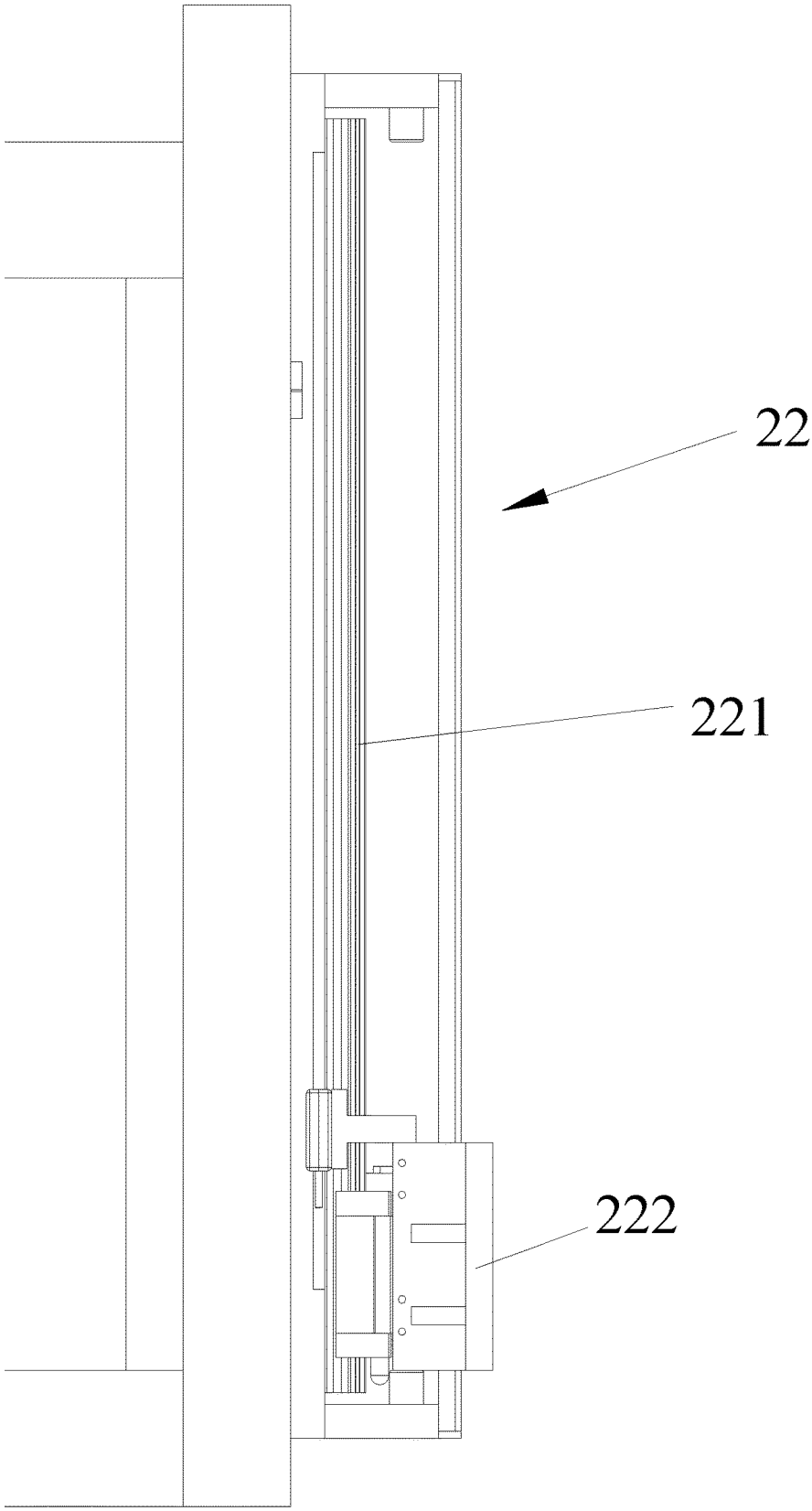
FIG. 4 is a top view of the X-axis moving assembly in the first embodiment of the present invention.
Figure 5:
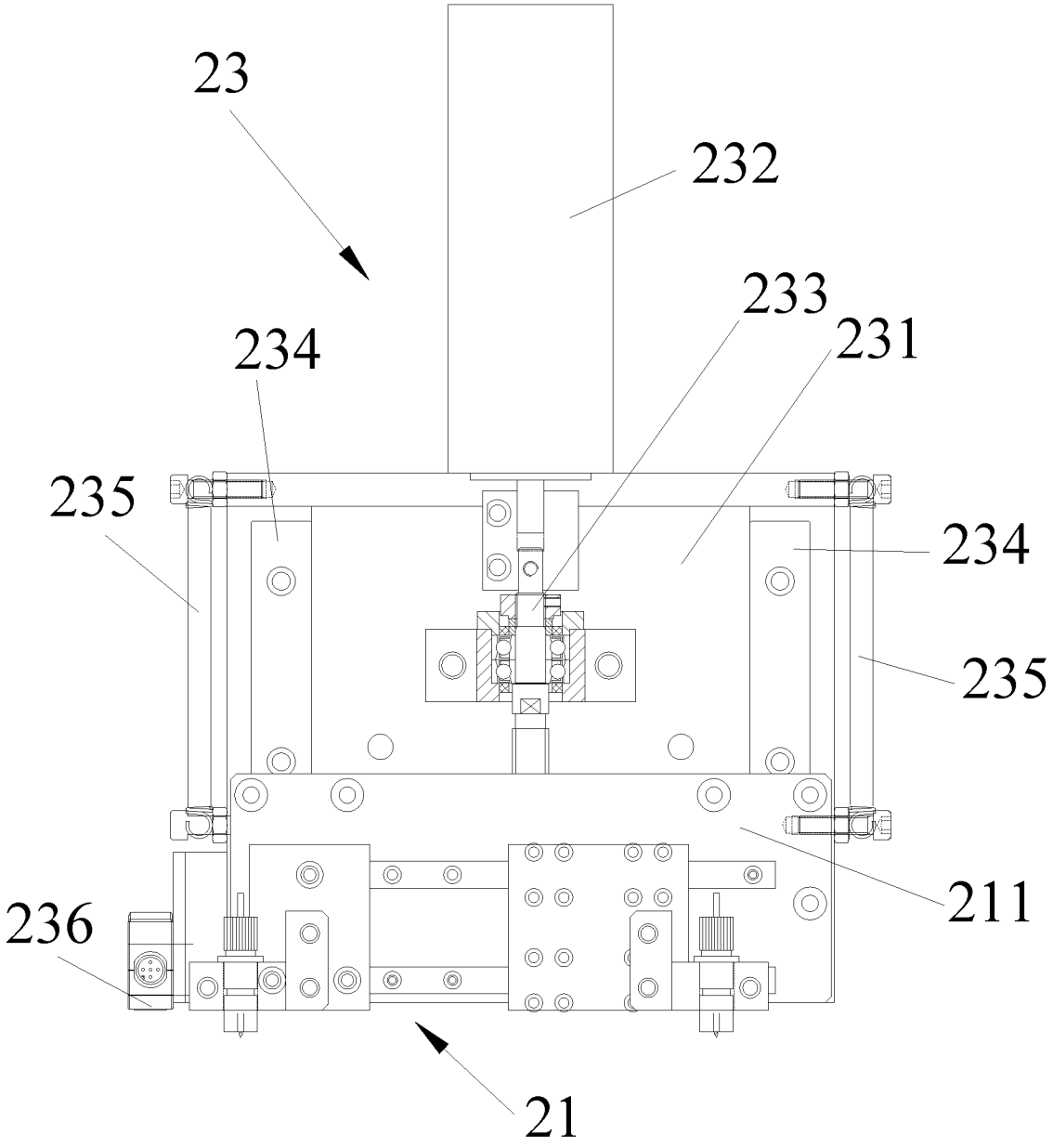
FIG. 5 is a right side view of the Z-axis moving assembly in the first embodiment of the present invention.
Figure 6:
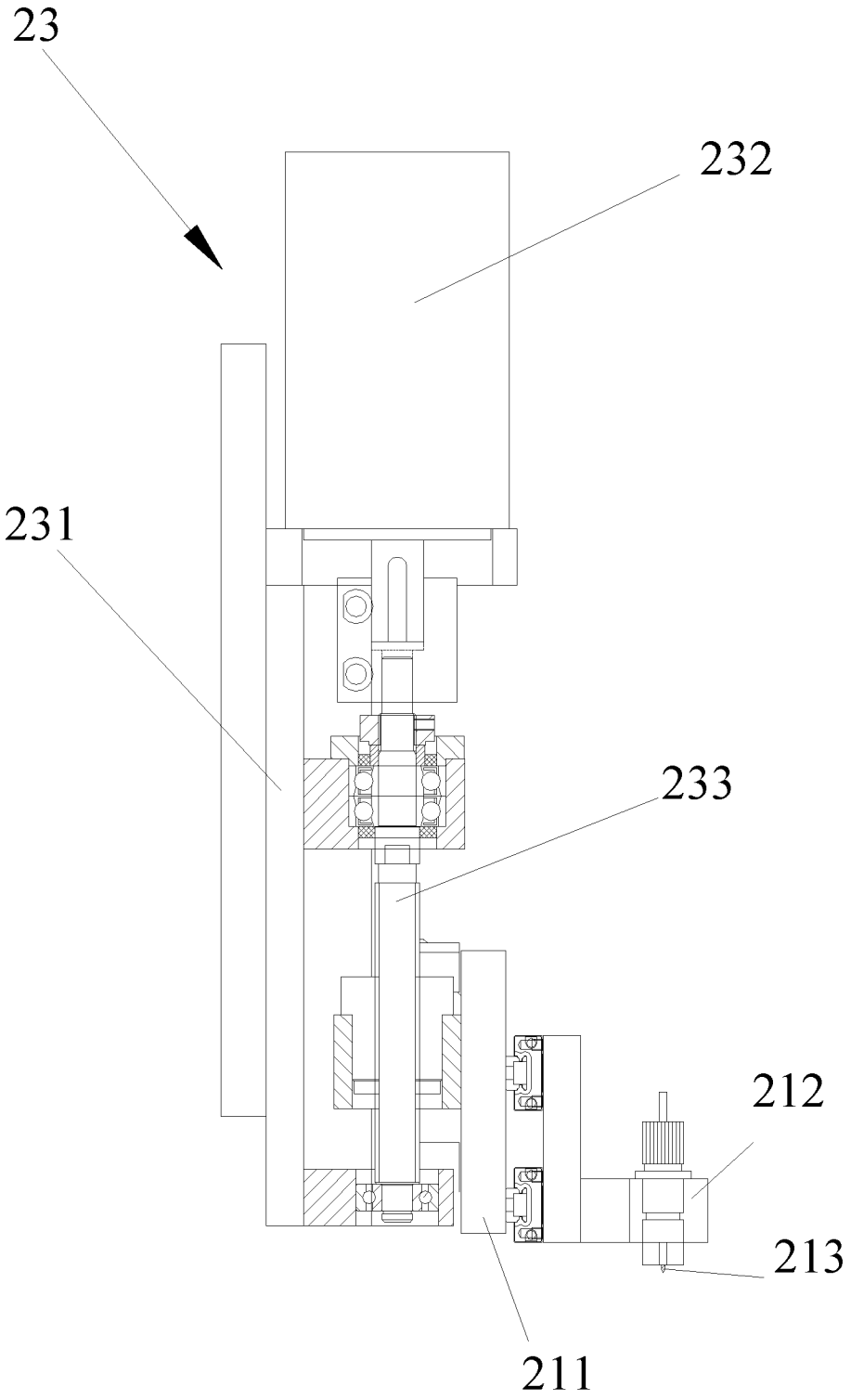
FIG. 6 is a main view of the Z-axis moving assembly and the lettering assembly in the first embodiment of the present invention.
Figure 7:
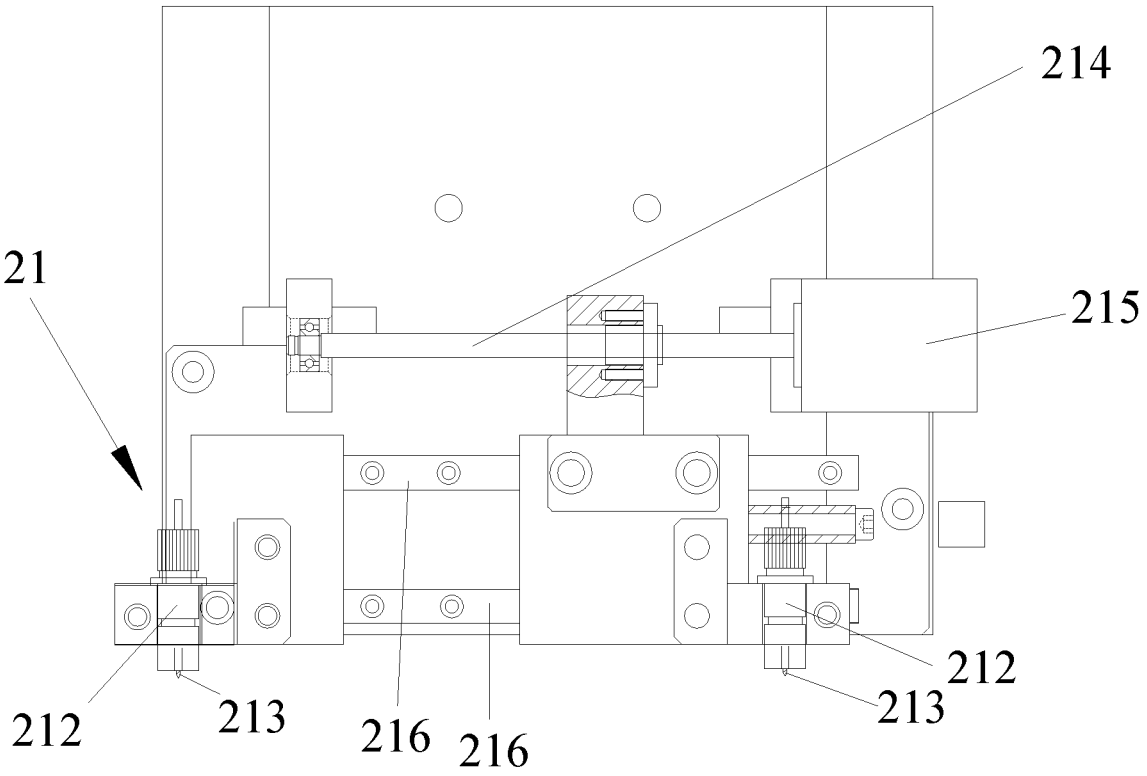
FIG. 7 is a right side view of the lettering assembly in the first embodiment of the present invention.
Figure 8:
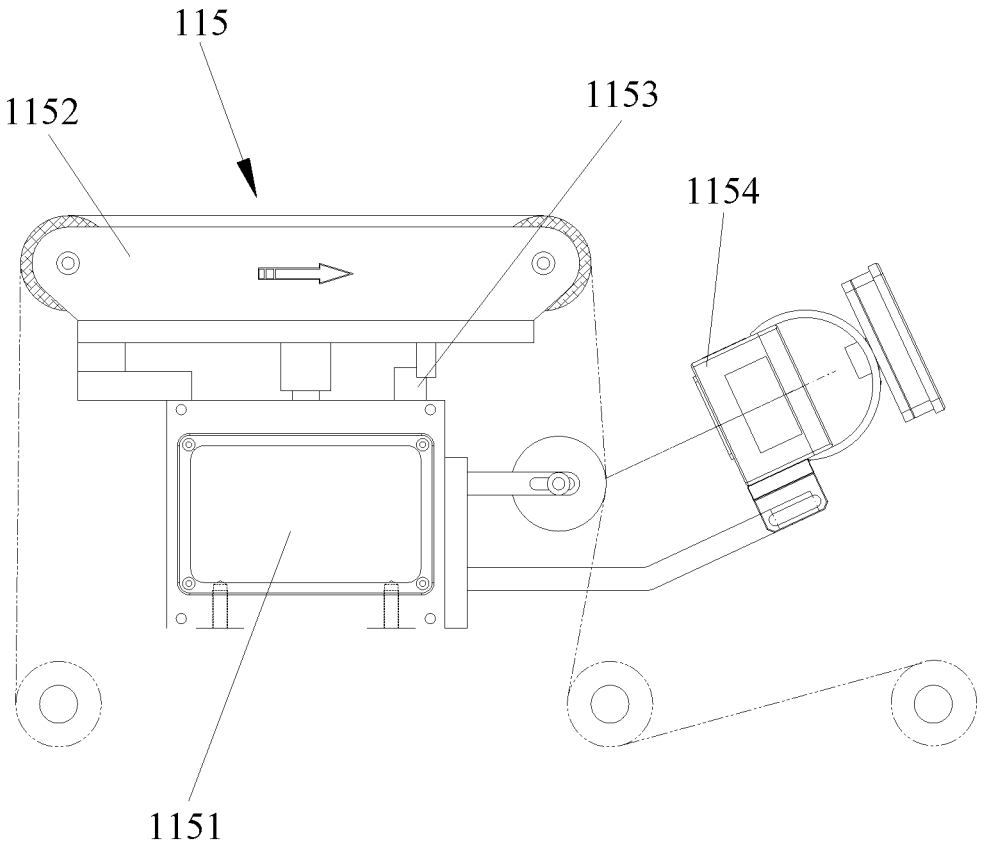
FIG. 8 is a main view of the deviation rectifying assembly in the first embodiment of the present invention.
Figure 9:
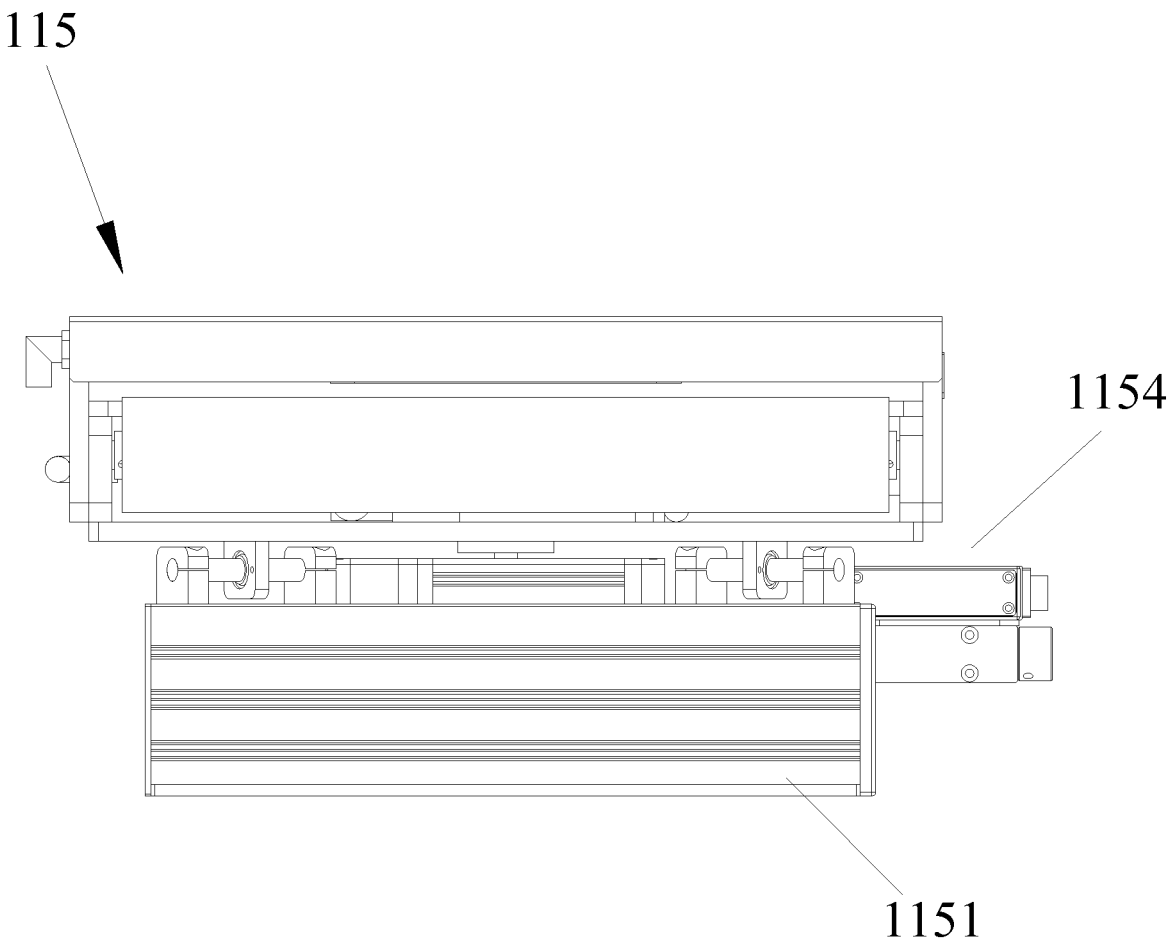
FIG. 9 is a left side view of the deviation rectifying assembly in the first embodiment of the present invention.
Figure 10:
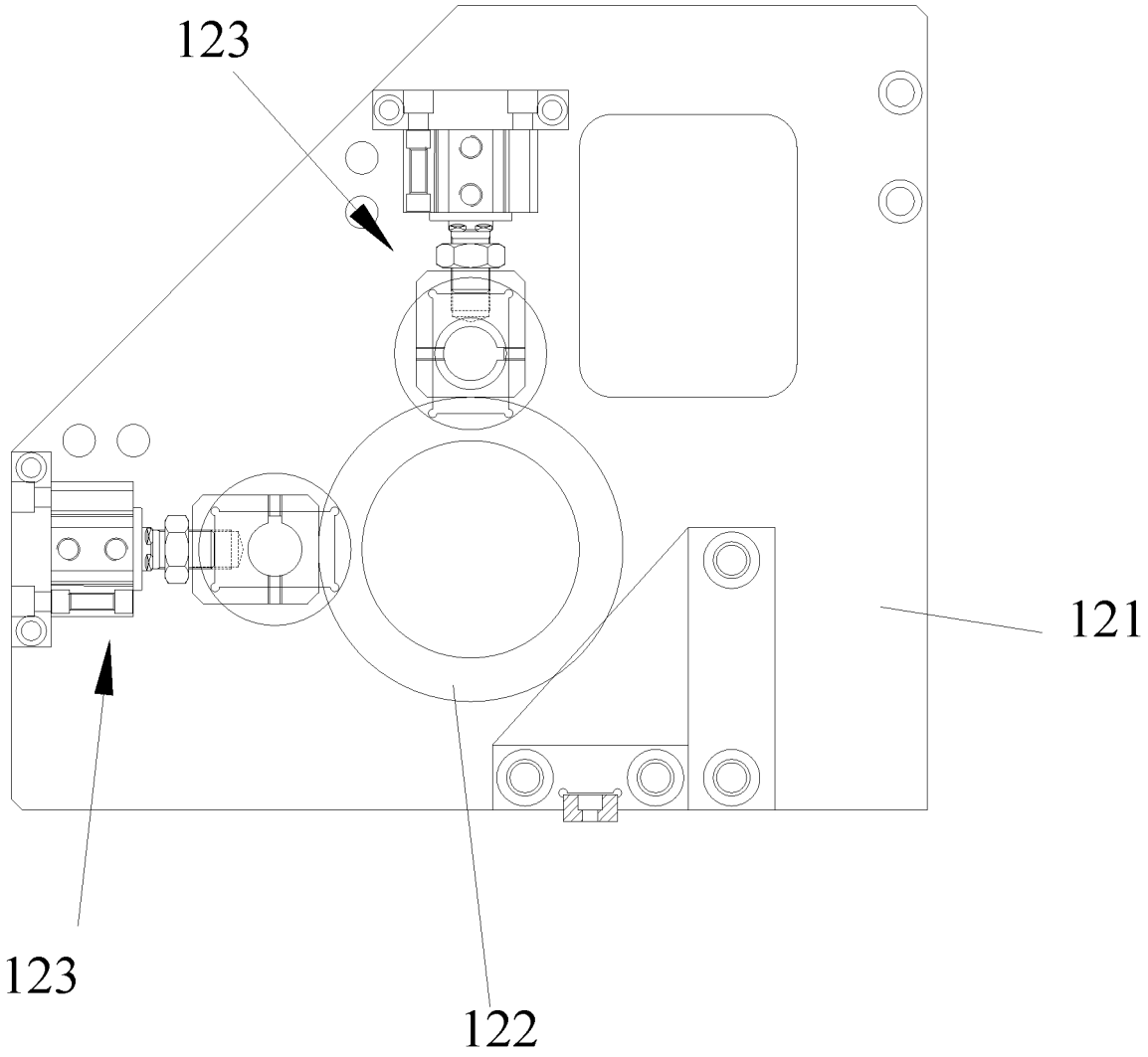
FIG. 10 is a main view of the connection of the paper pulling assembly and the main paper pulling roller on the left side of the working platform in the first embodiment of the present invention.
Figure 11:
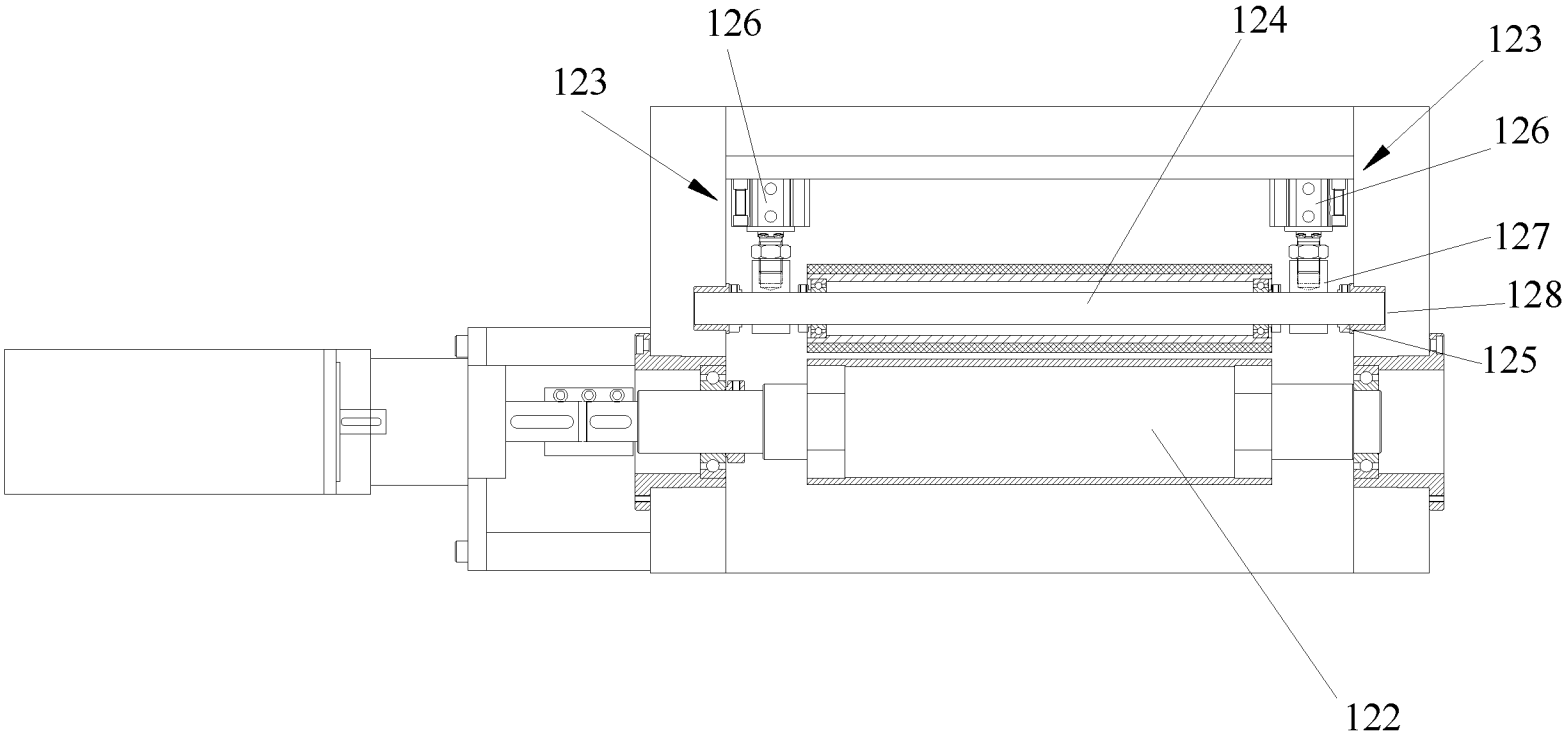
FIG. 11 is a left side view of the connection of the paper pulling assembly and the main paper pulling roller located on the left side of the working platform in the first embodiment of the present invention.
Figure 12:
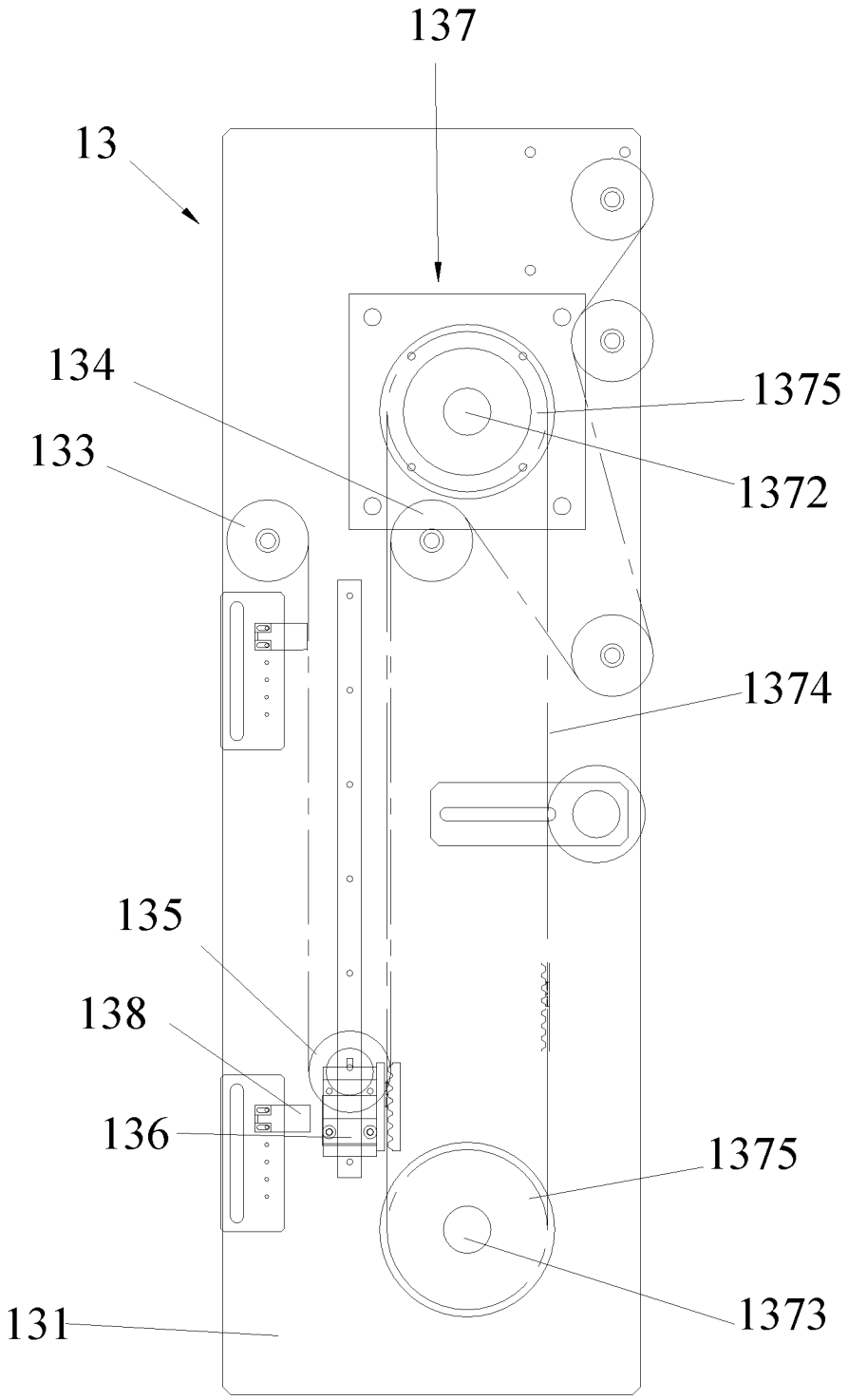
FIG. 12 is a main view of the paper feeding mechanism located on the left side of the working platform in the first embodiment of the present invention.
Figure 13:
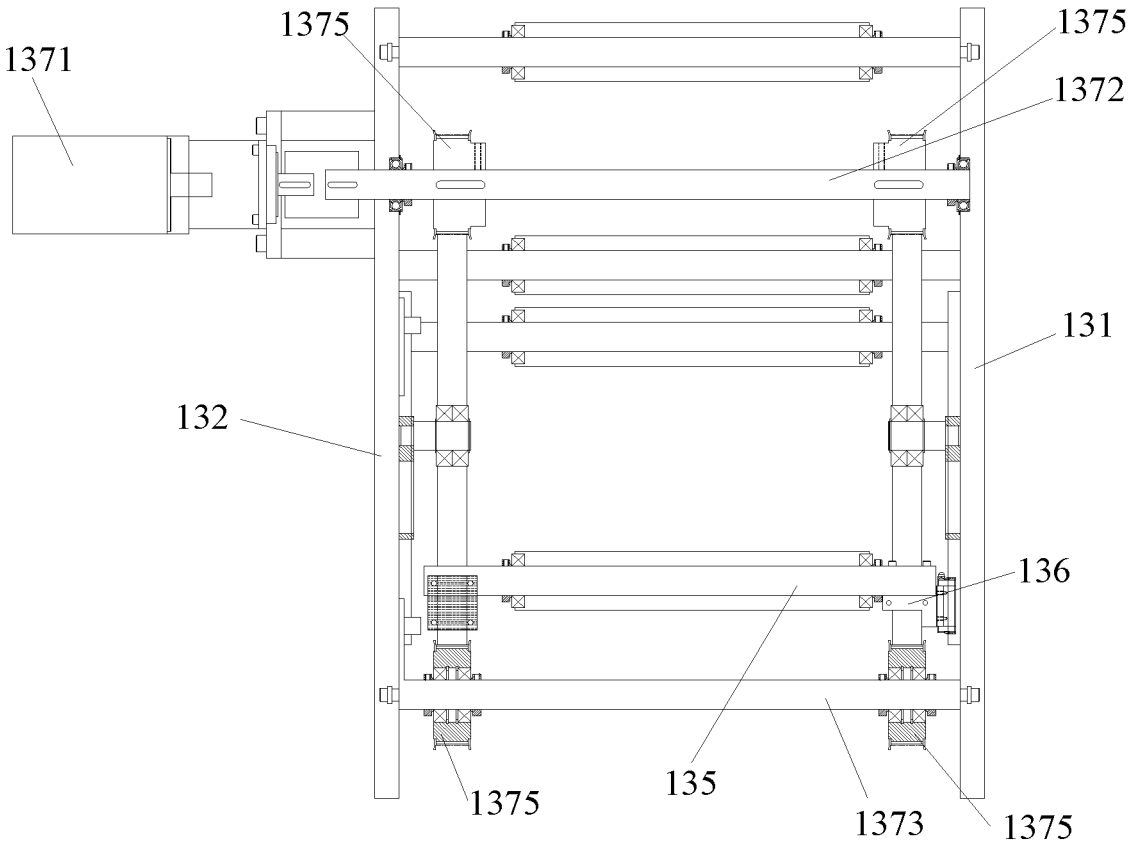
FIG. 13 is a left side view of the paper feeding mechanism located on the left side of the working platform in the first embodiment of the present invention.
Figure 14:
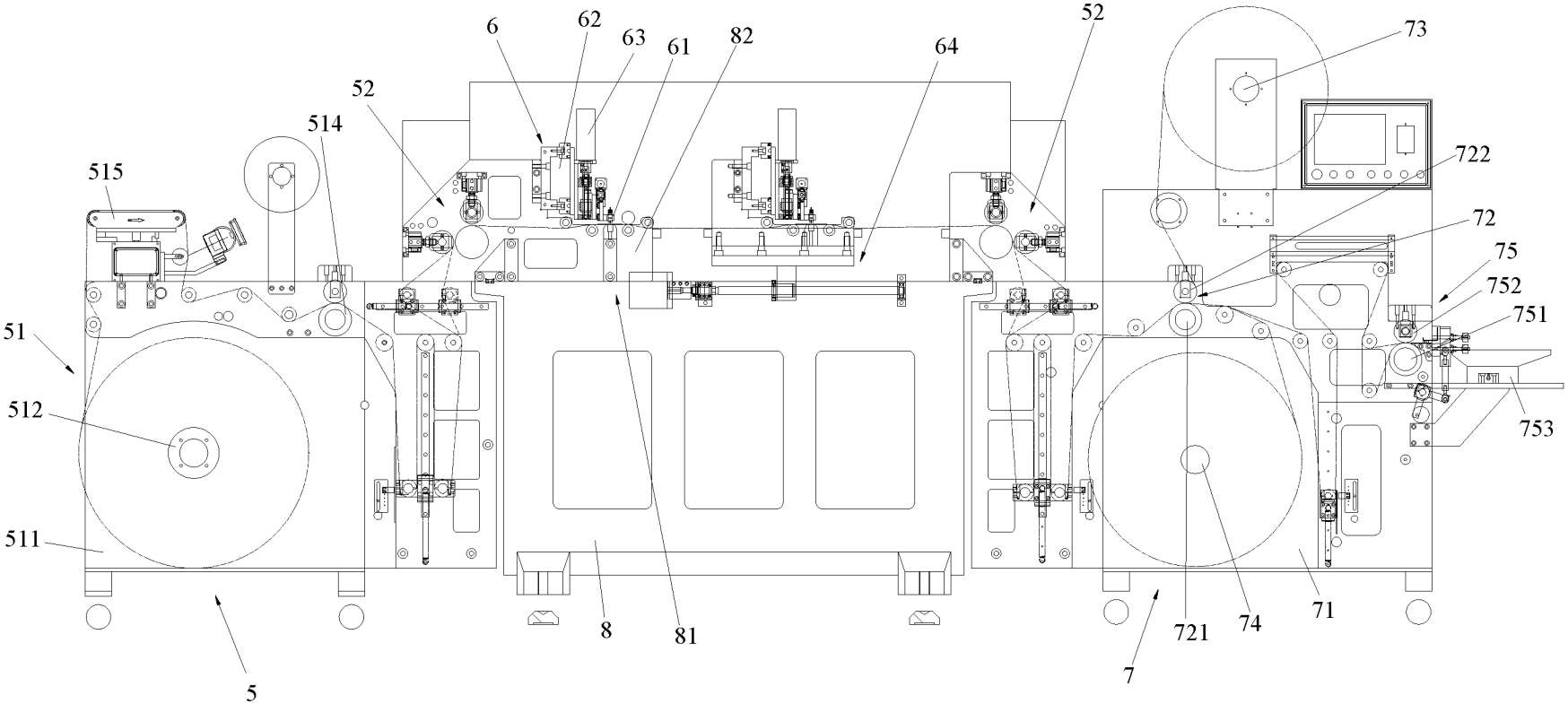
FIG. 14 is a main view of the lettering machine in the second embodiment of the present invention.
Figure 15:
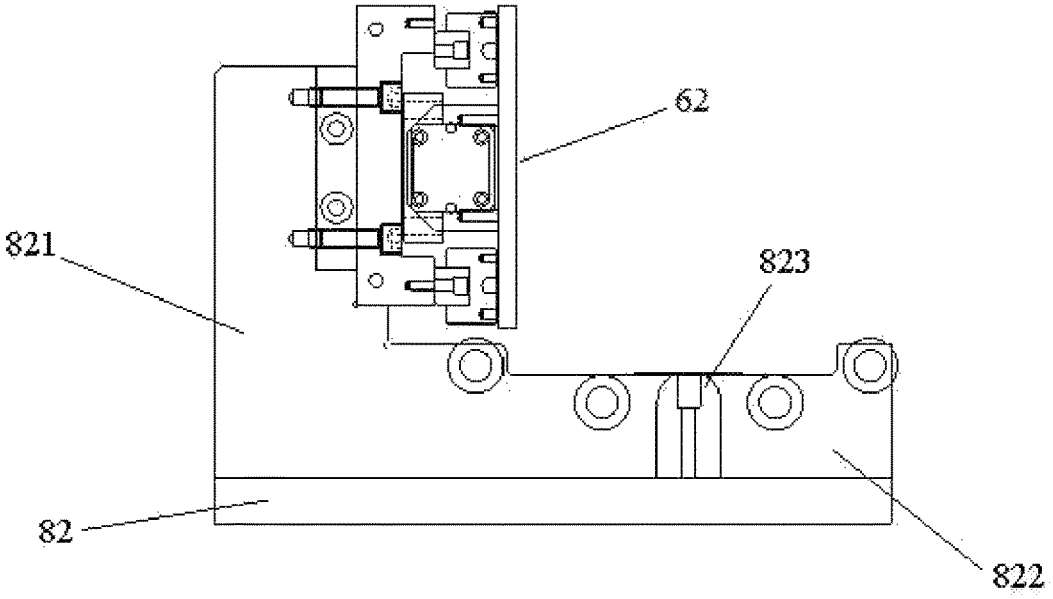
FIG. 15 is a main view of the connection of the mounting base and the X-axis moving assembly in the second embodiment of the present invention.
Figure 16:
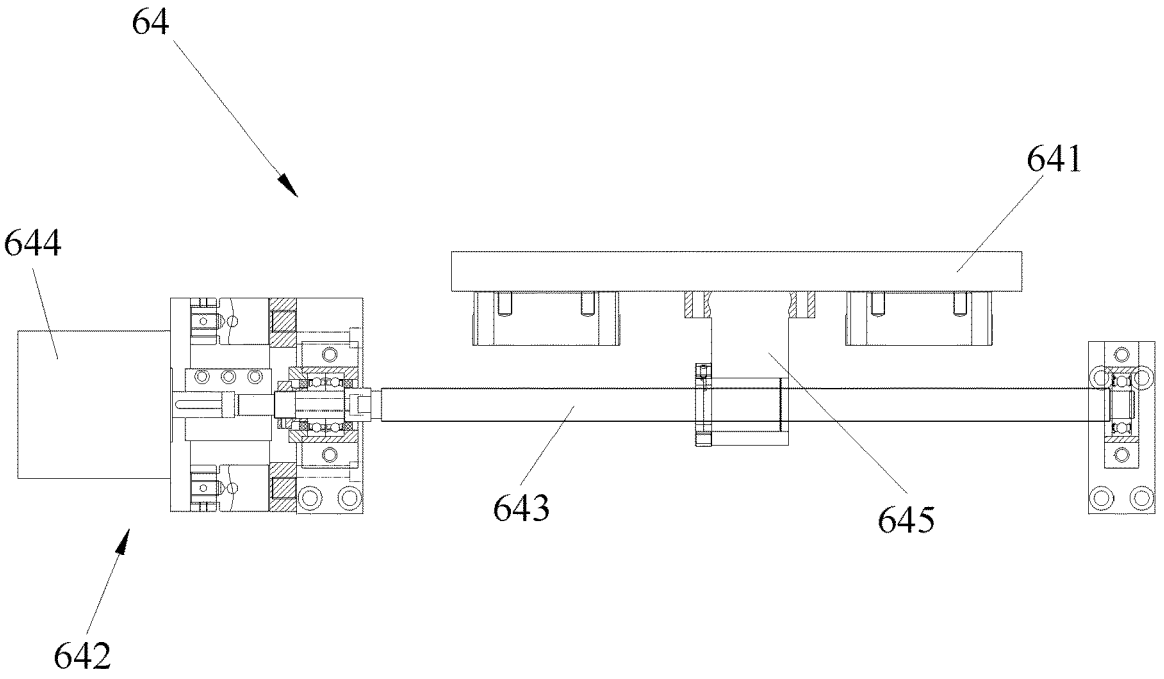
FIG. 16 is a main view of the sliding assembly in the second embodiment of the present invention.
Figure 17:
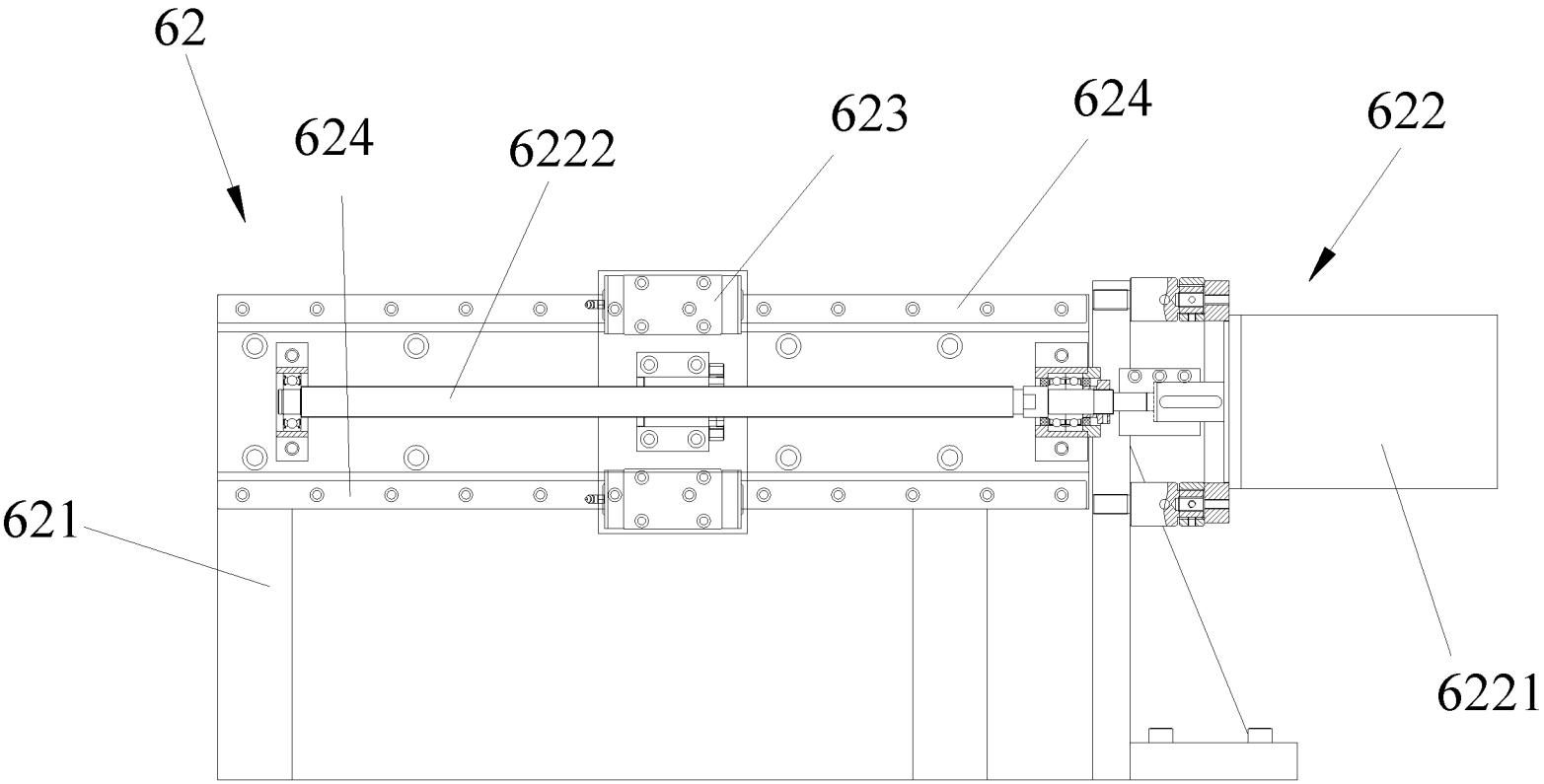
FIG. 17 is a right side view of the X-axis moving assembly in the second embodiment of the present invention.
Figure 18:
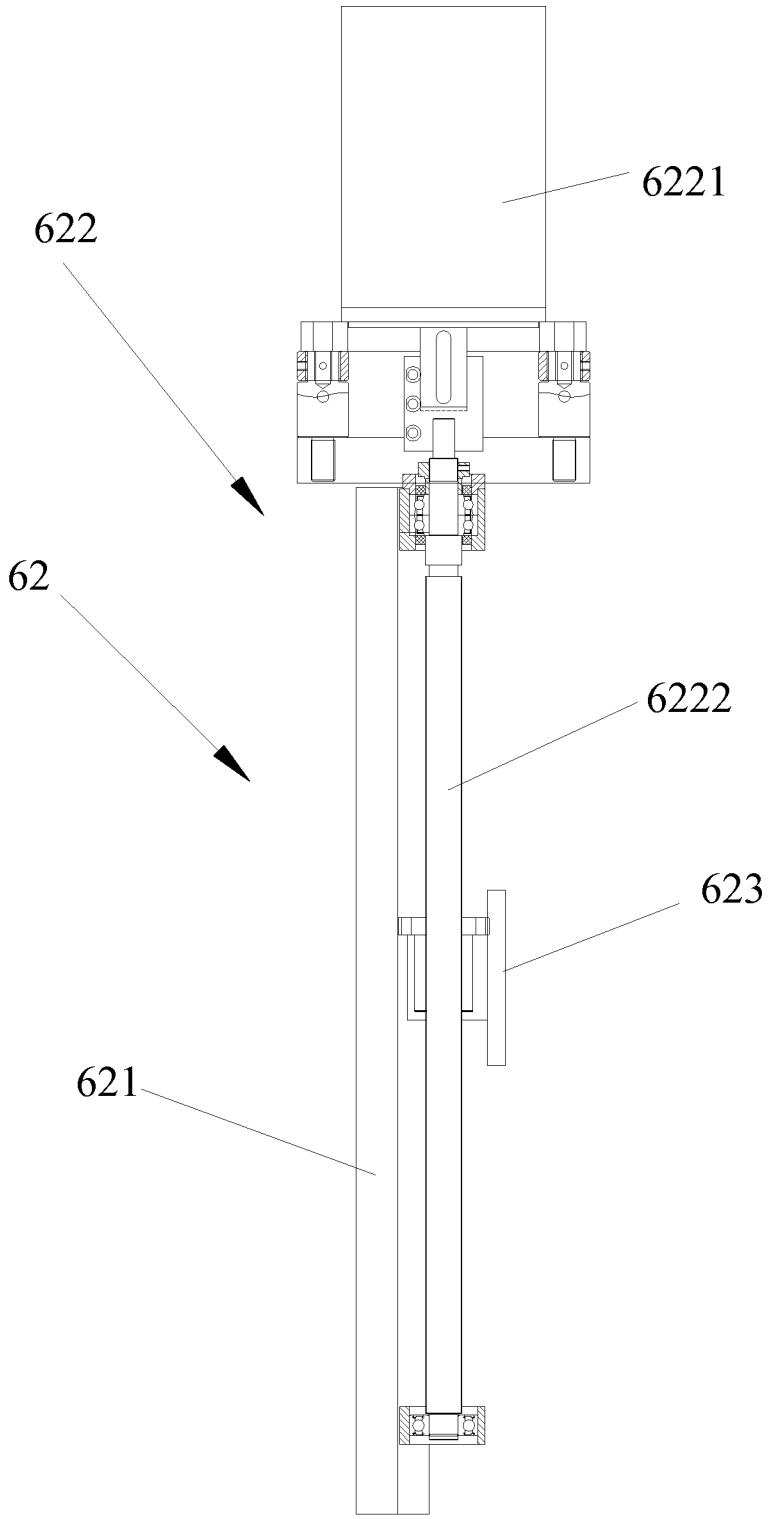
FIG. 18 is a top view of the X-axis moving assembly in the second embodiment of the present invention.
Figure 19:
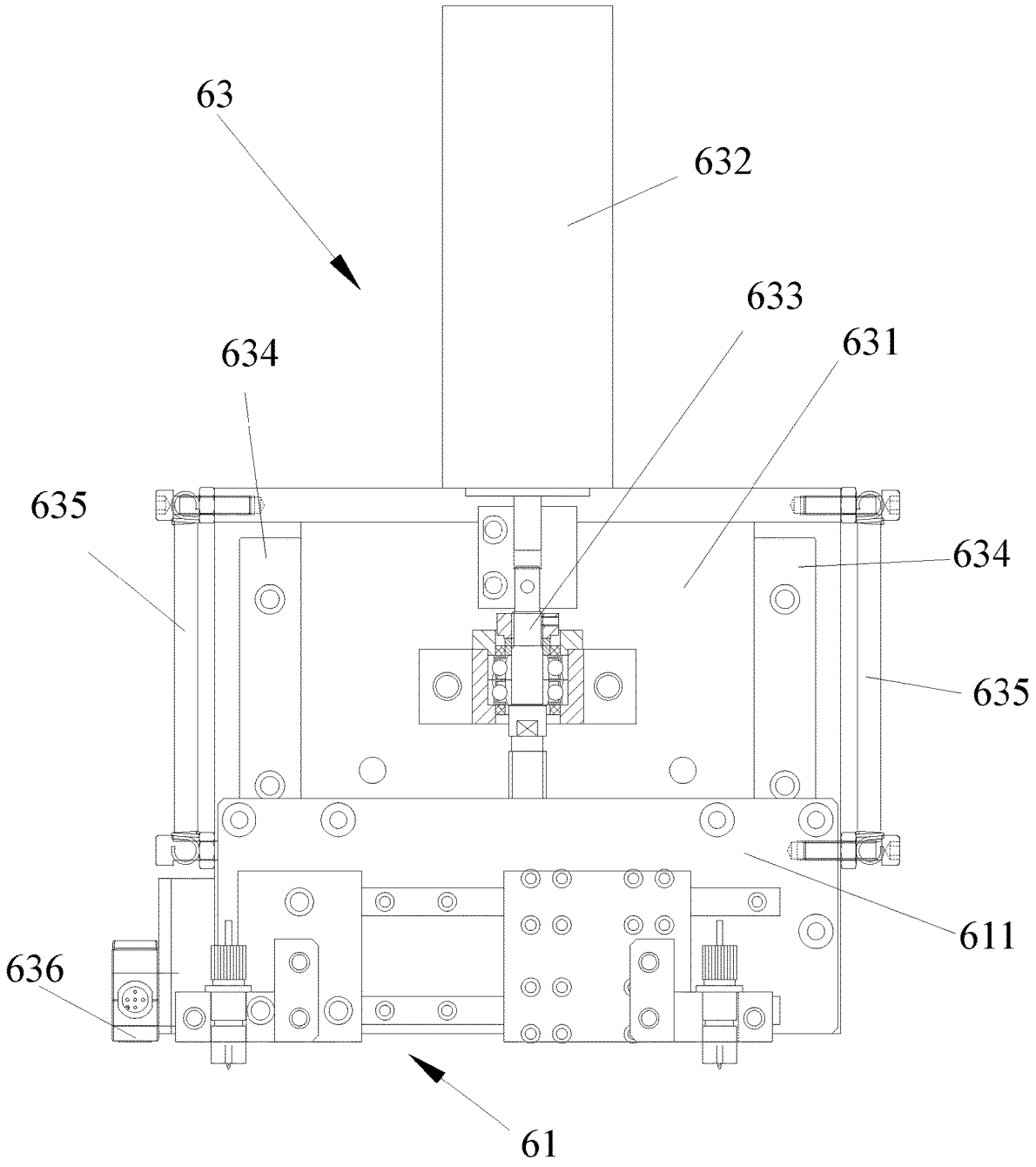
FIG. 19 is a right side view of the Z-axis moving assembly in the second embodiment of the present invention.
Figure 20:
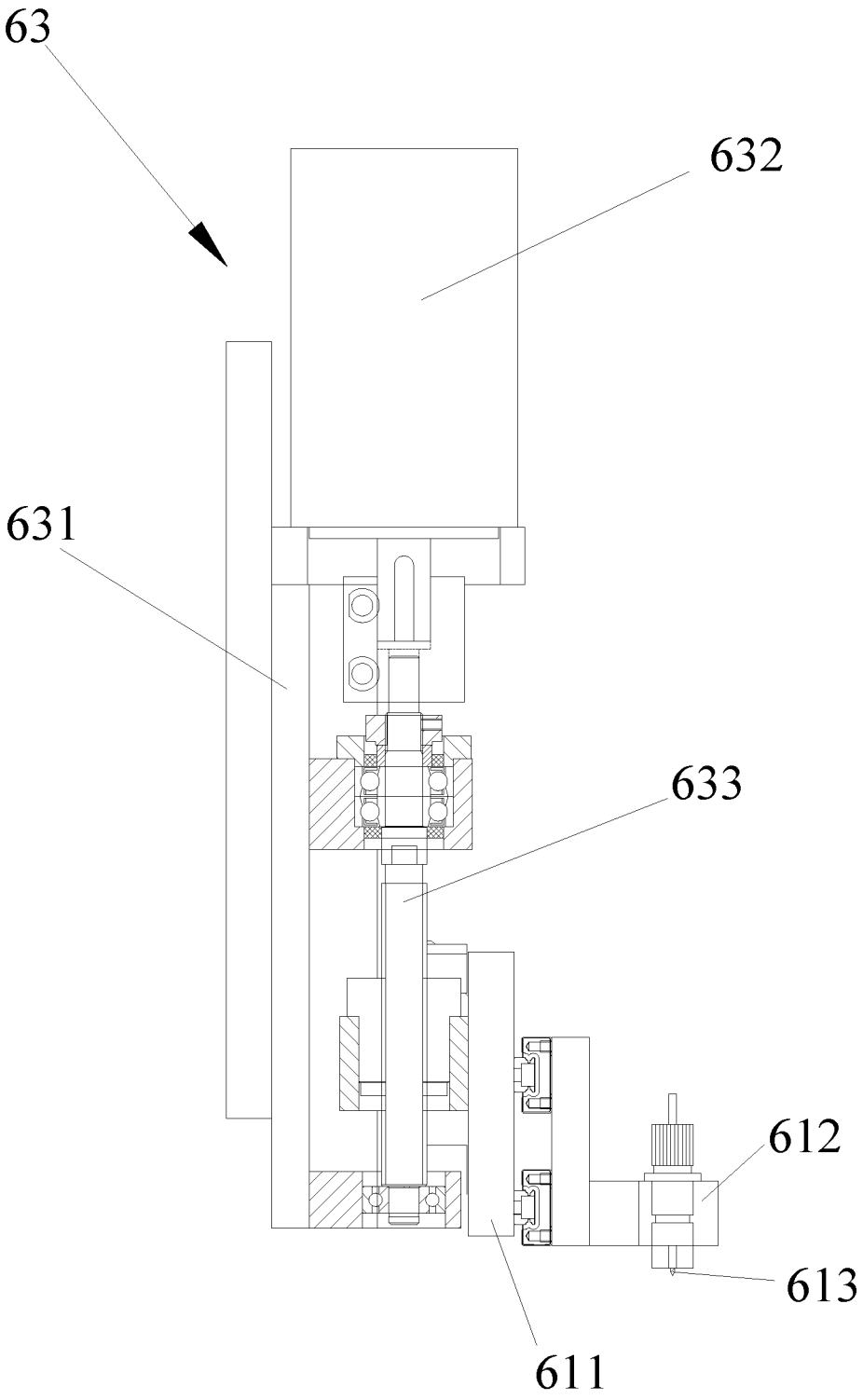
FIG. 20 is a main view of the Z-axis moving assembly and the lettering assembly in the second embodiment of the present invention.
Figure 21:
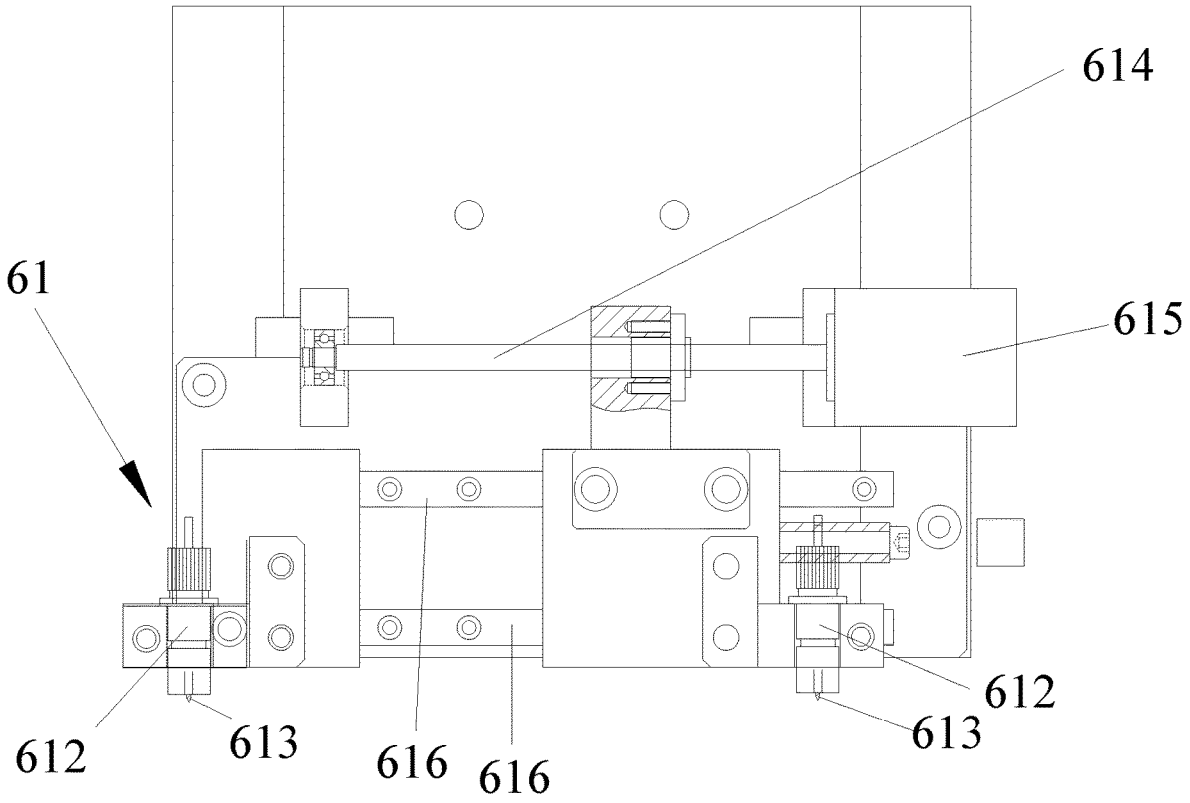
FIG. 21 is a right side view of the lettering assembly in the second embodiment of the present invention.
Figure 22:
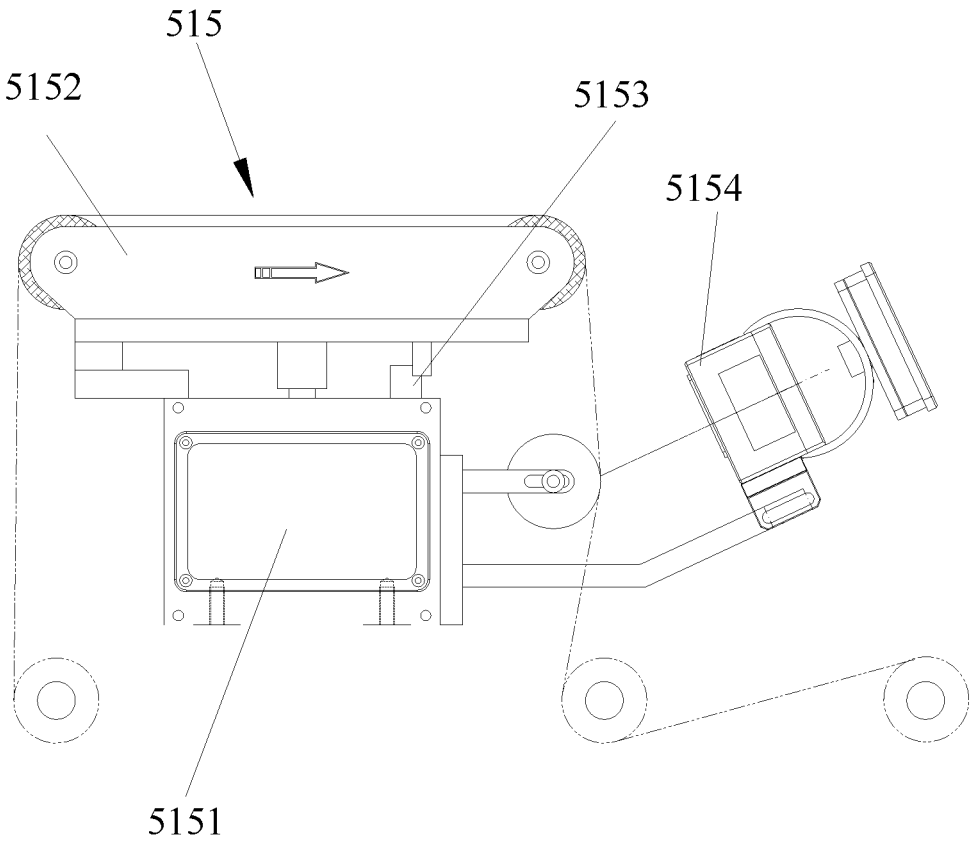
FIG. 22 is a main view of the deviation rectifying assembly in the second embodiment of the present invention.
Figure 23:
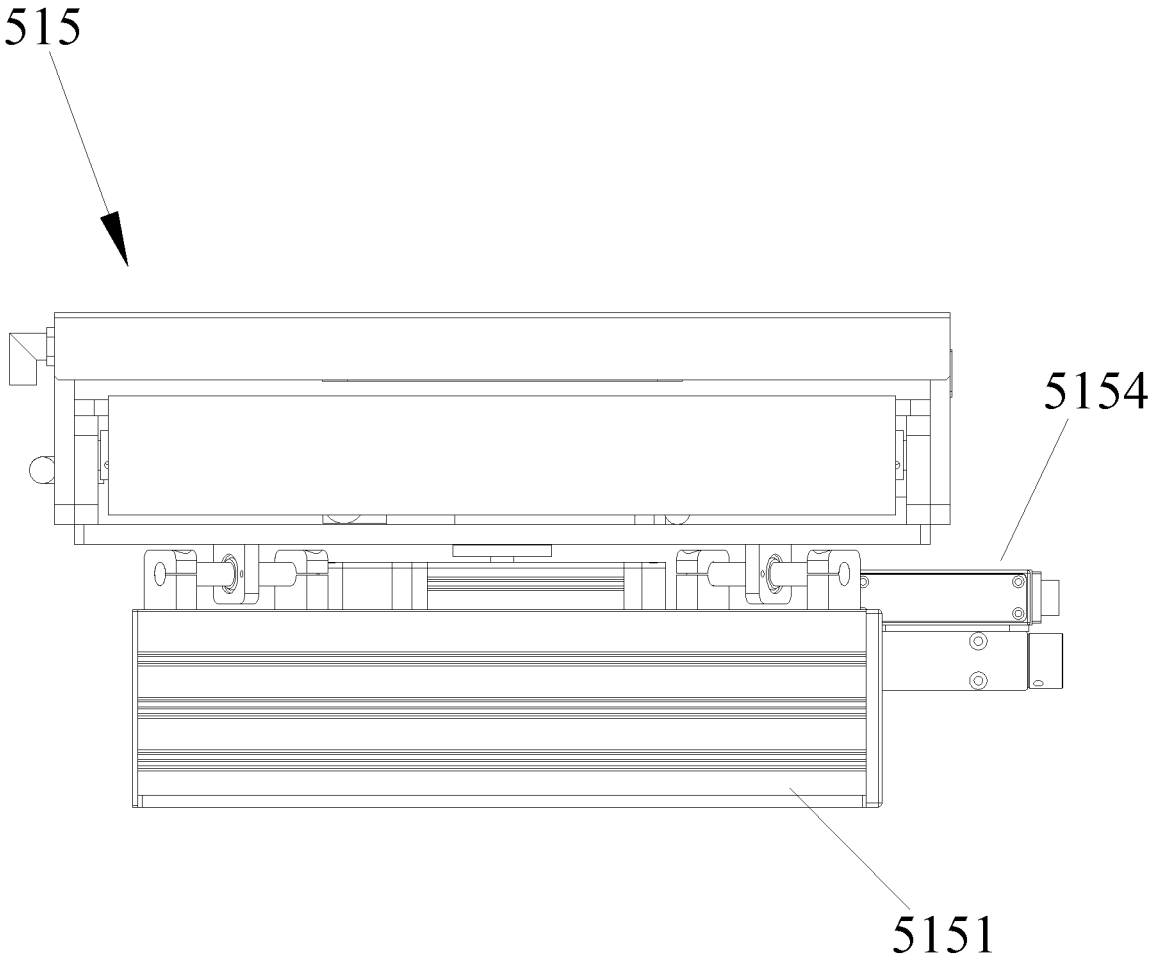
FIG. 23 is a left side view of the deviation rectifying assembly in the second embodiment of the present invention.
Figure 24:
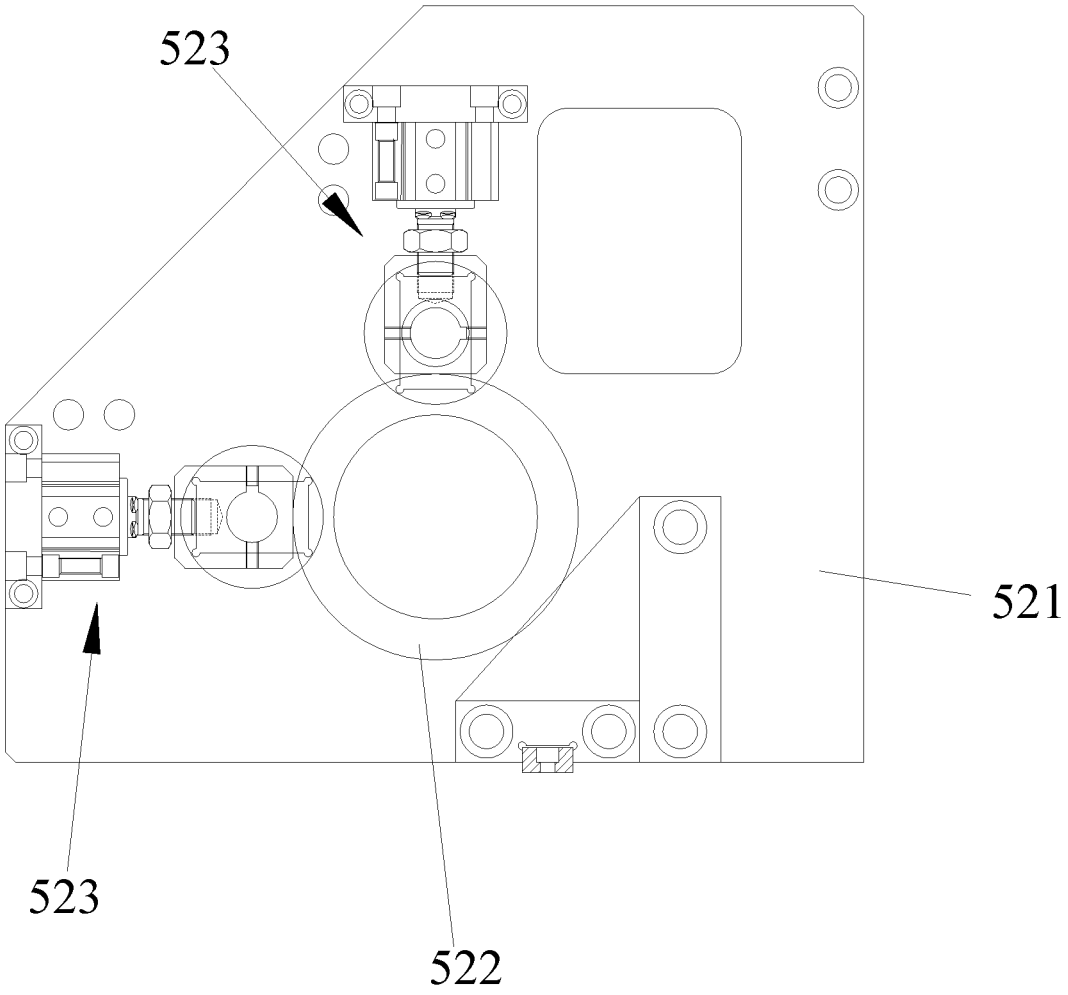
FIG. 24 is a main view of the connection of the paper pulling assembly and the main pulling roller located on the left side of the work platform in the second embodiment of the present invention.
Figure 25:
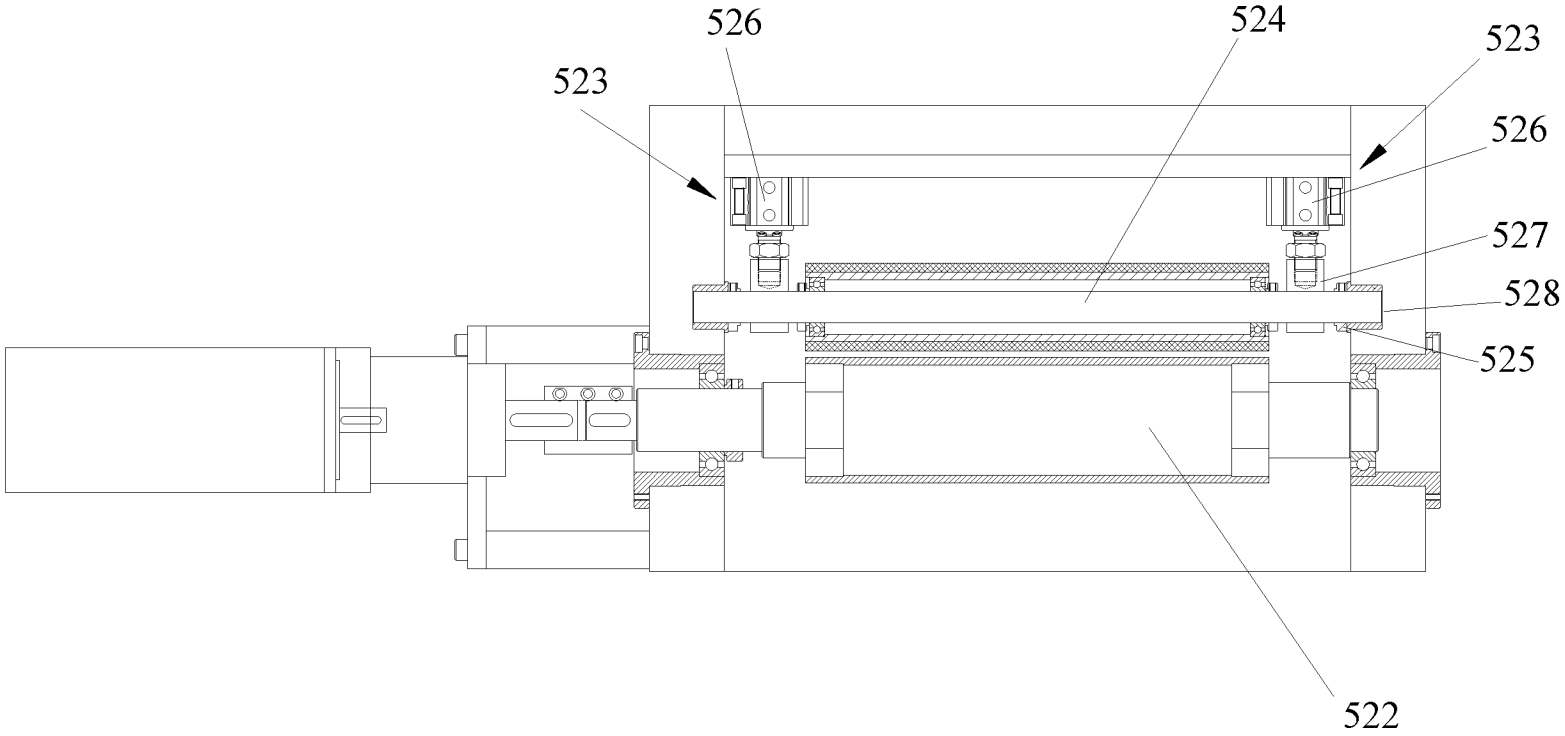
FIG. 25 is a left side view of the connection of the paper pulling assembly and the main pulling roller located on the left side of the work platform in the second embodiment of the present invention.
Figure 26:
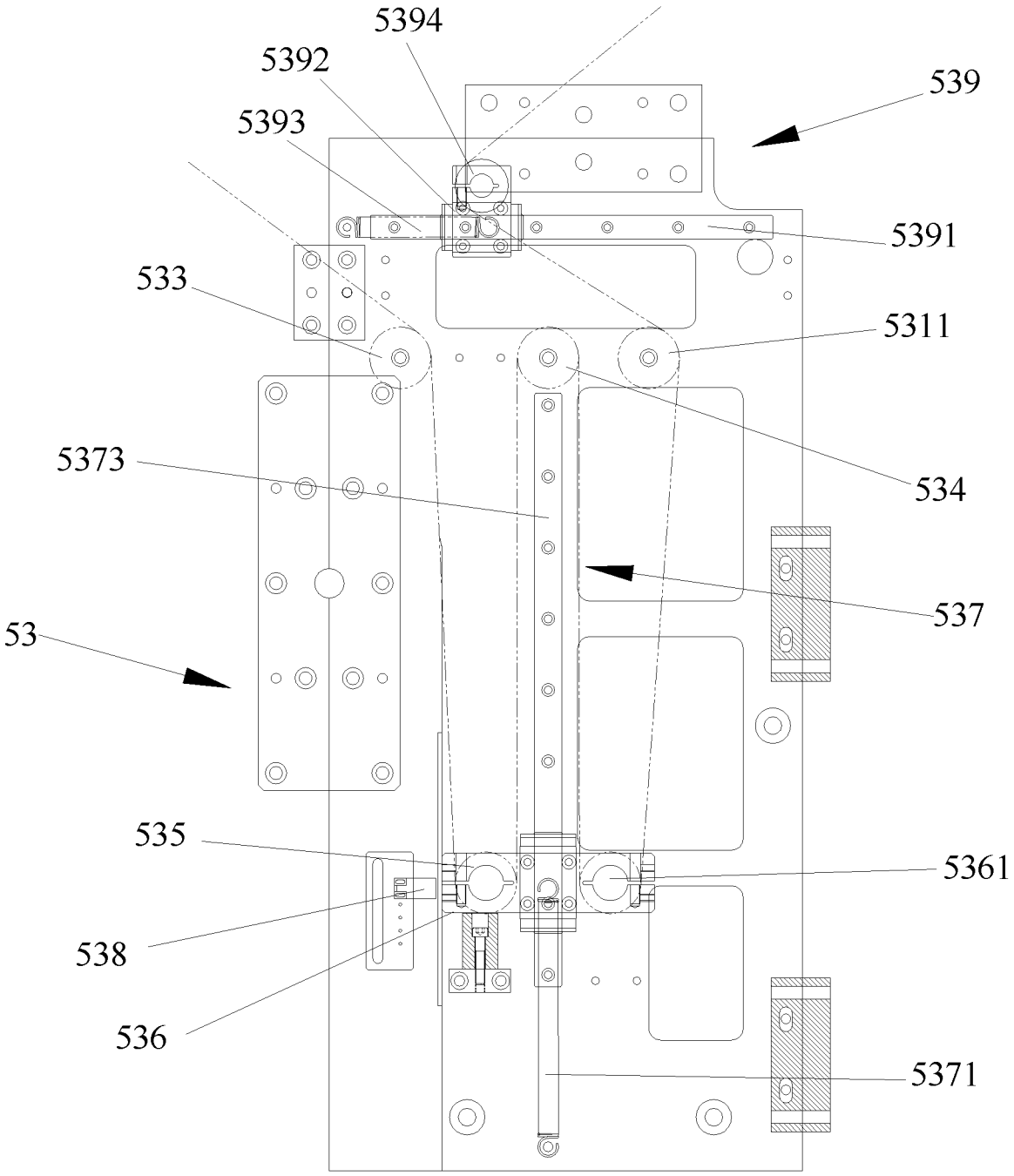
FIG. 26 is a main view of the paper feeding mechanism located on the left side of the working platform in the second embodiment of the present invention.
Figure 27:
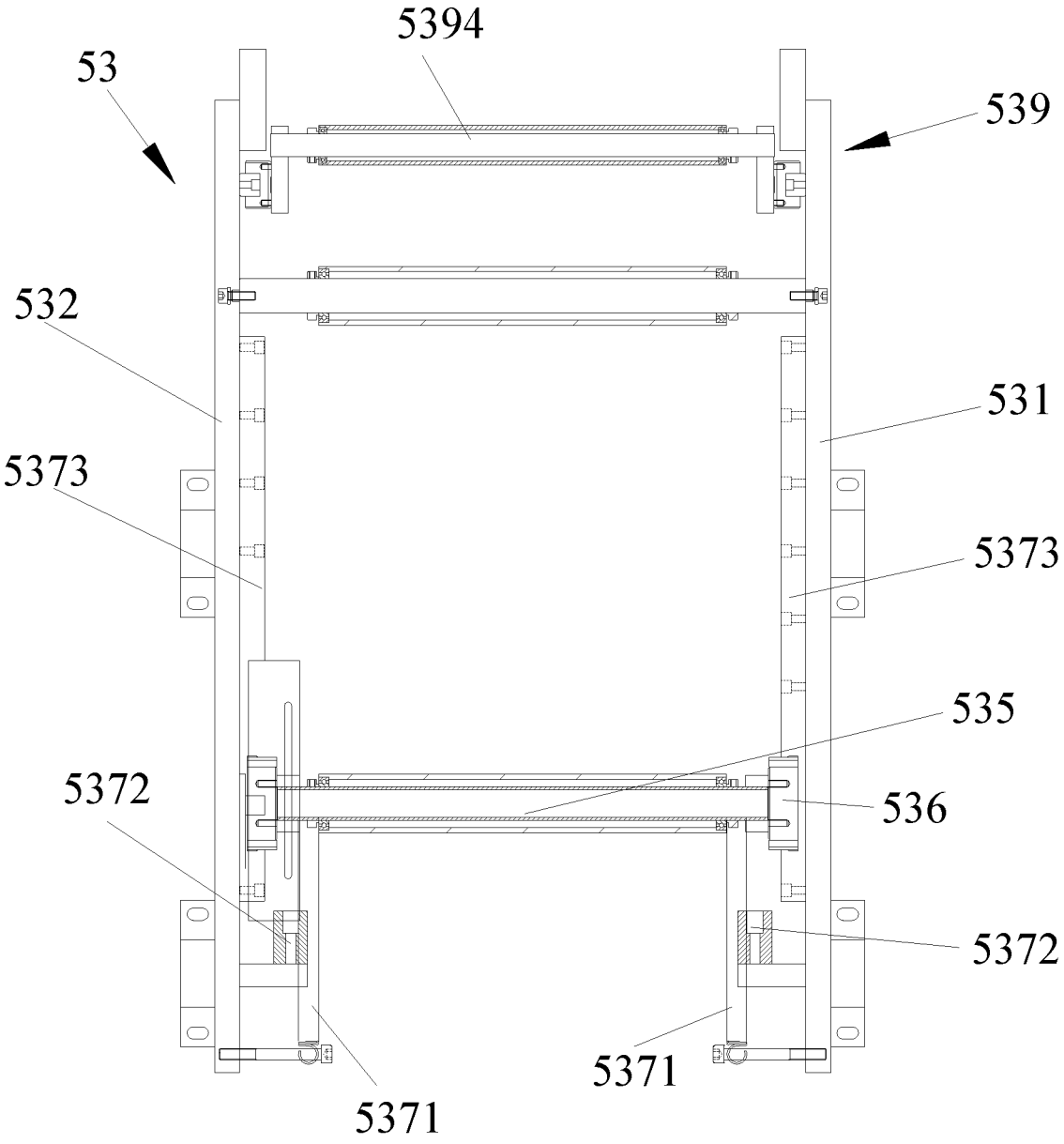
FIG. 27 is a left side view of the paper feeding mechanism located on the left side of the working platform in the second embodiment of the present invention.

In order to make the objects, technical solutions and advantages of the present invention more apparent, the present invention will be described in further detail below with reference to the accompanying drawings and embodiments. It should be understood that the specific embodiments described herein are only used to explain the present invention and are not used to limit the present invention.

An energy-saving environment-friendly digital lettering machine achieved by the present invention, which comprises a conveying mechanism, a rewinding mechanism and a machine base, wherein the machine base is provided with a working platform, and the conveying mechanism and the rewinding mechanism are respectively arranged on the left side and the right side of the working platform, is characterized in that the lettering machine further comprise a lettering mechanism, the working platform is provided with at least one lettering mechanism and a mounting base, and each lettering mechanism is arranged on the working platform through a corresponding mounting base, wherein the conveying mechanism, the lettering mechanism and the rewinding mechanism are all electrically connected with a control system of the lettering machine; each lettering mechanism comprises a lettering assembly, an X-axis moving assembly and a Z-axis moving assembly, wherein the lettering assembly is fixedly arranged on the Z-axis moving assembly, the lettering assembly slides up and down on the Z-axis moving assembly, the Z-axis moving assembly is fixedly arranged on the X-axis moving assembly, and the Z-axis moving assembly and the lettering assembly slide on the X-axis moving assembly synchronously.

In the present application, in the horizontal plane, the direction perpendicular to the conveying direction of the material part is the X-axis direction, and the conveying direction of the material part is the Y-axis direction, and the vertical direction is the Z-axis direction. The pattern files required to be produced are introduced into the control system, the control system controls the conveying mechanism to convey the material part to the lettering mechanism, wherein the conveying mechanism can realize the forward and backward movement of the material part, thereby controlling the movement of the material part in the Y-axis direction, which is matched with the movement of the lettering assembly in the X-axis and Z-axis directions, the X-axis moving assembly controls the Z-axis moving assembly and the lettering assembly to slide in the X-axis direction, the Z-axis moving assembly controls the lettering assembly to ascend and descend in the Z-axis direction, thereby controlling the lettering depth of the material part by the lettering assembly and further controlling the lettering assembly to engrave various patterns of the material part, and the rewinding mechanism receives and discharges the processed material part to meet the production requirement; meanwhile, the feeding direction of the existing conveying mechanism is used as a movement control direction of the lettering assembly, so that the mechanism of the existing lettering machine can be fully utilized, the mechanism setting is simplified, and the manufacturing cost is reduced.

The specific implementation process comprises a plurality of embodiments, wherein FIGS. 1-13 show the first embodiment, FIGS. 14-27 show the second embodiment; in the first embodiment, only one lettering mechanism is fixedly provided on the working platform, and the paper feeding mechanism is of a swing roller type structure; in the second embodiment, two lettering mechanisms are provided on the working platform, wherein one lettering mechanism is fixed on the working platform, and the other lettering mechanism is movably provided on the working platform, and the paper feeding mechanism is of a double spring buffer structure. The method is specifically realized as follows:

First Embodiment: Referring to FIGS. 1-13

An energy-saving environment-friendly digital lettering machine, which comprises a conveying mechanism 1, a rewinding mechanism 3 and a machine base 4, wherein the machine base is provided with a working platform 41, and the conveying mechanism 1 and the rewinding mechanism 3 are respectively arranged on the left side and the right side of the working platform 41, is characterized in that the lettering machine further comprise a lettering mechanism 2 which is arranged on the working platform 41 through a mounting base 42 corresponding to the lettering mechanism 2, wherein the conveying mechanism 1, the lettering mechanism 2 and the rewinding mechanism 3 are all electrically connected with a control system (not shown) of the lettering machine; the lettering mechanism 2 comprises a lettering assembly 21, an X-axis moving assembly 22 and a Z-axis moving assembly 23, wherein the lettering assembly 21 is arranged on the Z-axis moving assembly 23, the lettering assembly 21 slides up and down on the Z-axis moving assembly 23, the Z-axis moving assembly 23 is fixedly arranged on the X-axis moving assembly 22, and the Z-axis moving assembly 23 and the lettering assembly 21 slide together on the X-axis moving assembly 22.

In the present application document, in the horizontal plane, the direction perpendicular to the conveying direction of the material part is the X-axis direction, and the conveying direction of the material part is the Y-axis direction, and the vertical direction is the Z-axis direction. The pattern files required to be produced are introduced into the control system, the control system controls the conveying mechanism 1 to convey the material part to the lettering mechanism 2, wherein the conveying mechanism 1 can realize the forward and backward movement of the material part, thereby controlling the movement of the material part in the Y-axis direction, which is matched with the movement of the lettering assembly 21 in the X-axis and Z-axis directions, the X-axis moving assembly 22 controls the Z-axis moving assembly 23 and the lettering assembly 21 to slide in the X-axis direction, the Z-axis moving assembly 23 controls the lettering assembly 21 to ascend and descend in the Z-axis direction, thereby controlling the lettering depth of the material part by the lettering assembly 21 and further controlling the lettering assembly 21 to engrave various patterns of the material part, and the rewinding mechanism 3 receives and discharges the processed material part to meet the production requirement; meanwhile, the feeding direction of the existing conveying mechanism is used as a movement control direction of the lettering assembly, so that the mechanism of the existing lettering machine can be fully utilized, the mechanism setting is simplified, and the manufacturing cost is reduced.

In the present embodiment, the mounting base 42 and the X-axis moving assembly 22 are fixedly connected, the mounting base 42 is provided with a channel for conveying the material part, and the mounting base 42 includes a first mounting portion 421 and a second mounting portion 422, wherein the first mounting portion 421 is connected to the second mounting portion 422 at a certain angle to form an L-shaped structure, and a tool bit base 423 adapted to the lettering assembly 21 is provided on the second mounting portion 422.

In the present embodiment, the number of the lettering mechanism 2 is set to be one, and the lettering mechanism 2 is fixedly provided on the working platform 41 through the corresponding mounting base 42.

In this embodiment, the X-axis moving assembly 22 is a linear motor which includes a motor body 221 and a mover seat 222 sliding on the motor body, and the mover seat 222 is fixedly connected to the Z-axis moving assembly 23. The linear motor is a prior art, preferably, the linear motor uses an absolute value encoder, which utilizes the characteristic of the absolute value encoder, namely the absolute value encoder determines encoding according to a mechanical position, so that the anti-interference characteristic and the data reliability of the absolute value encoder are greatly improved.

In the present embodiment, the Z-axis moving assembly 23 includes a second base 231, a third motor 232 and a third screw rod 233, wherein the third motor 232 and the third screw rod 233 are both arranged on the second base 231, the second base 231 is provided with a second sliding rail 234, the third screw rod 233 and the second sliding rail 234 are arranged in parallel in the vertical direction, the third screw rod 233 is connected with the third motor 232, the second base 231 is fixedly connected with the X-axis assembly 22, and the third screw rod 233 and the second sliding rail 234 are both slidably connected with the lettering assembly 21. Preferably, the third motor 232 also adopts an absolute value encoder in the prior art, the third screw rod 233 is driven to rotate by the third motor 232, and the third screw rod 233 rotates to drive the lettering assembly 21 to move up and down along the second sliding rail 234 in the Z-axis direction.

In the present embodiment, the second base 231 is provided with a plurality of lifting buffer springs 235, one end of each lifting buffer spring 235 is fixedly connected to the second base 231, and the other end of each lifting buffer spring 235 is fixedly connected to the lettering assembly 21. In the up-and-down lifting process of the lettering assembly 21, the setting of the lifting buffer spring 235 can play a role in buffer, so that the speed of the lettering assembly 21 in ascending and descending is prevented from being too fast, the load of the third motor 232 is reduced, and the lifting buffer spring can help to support a part of weight when the lettering assembly moves.

In the present embodiment, the second base 231 is further provided with a color mark sensor 236, and the color mark sensor 236 is electrically connected to the control system. The color mark sensor 236 is a prior art, and is used for searching for pattern MARK points on the edge of the material part, and transmitting the signal to the control system for processing, so that the control system can control the lettering assembly 21 to carry out lettering operation on the material part.

In the present embodiment, the lettering assembly 21 includes a third base 211 and one or more tool aprons 212, wherein the third base 211 is slidably connected to the Z-axis moving assembly 23, the tool apron 212 is arranged on the third base 211, and the tool apron 212 is provided with cutting tool 213 which is corresponding to the tool bit base 423 on the mounting base 42.

In the present embodiment, the third base 211 is provided with a third sliding rail 216 which is horizontally arranged along the X-axis direction, when the third base 211 is provided with two or more tool aprons 212, at least one tool apron 212 is arranged on the third sliding rail 216, and each tool apron 212 arranged on the third sliding rail 216 is connected to a fourth screw rod 214 and a fourth motor 215 which correspond to the tool apron. When the third base 211 is provided with two or more tool aprons 212, the tool aprons 212 arranged on the third sliding rail 216 are all connected to the fourth screw rod 214 and the fourth motor 215 which correspond to the tool aprons, so that the fourth motor 215 drives the tool aprons 212 to slide in the horizontal direction along the fourth screw rod 214 and the third sliding rail 216, and the distance between the multiple tool aprons 212 can be adjusted to adapt to the lettering pattern of the material part, meanwhile, the processing efficiency of the lettering assembly 21 is further improved.

In the present embodiment, the conveying mechanism 1 includes a paper feeding assembly 11 and two paper pulling assemblies 12, the paper feeding assembly 11 is arranged on the left side of the working platform 41, the two paper pulling assemblies 12 are provided at a left end and a right end of the working platform 41 respectively, the paper feeding assembly 11 conveys the material part to the paper pulling assemblies 12 after unwinding the material part, the paper pulling assemblies 12 convey the material part to the working platform 41 and convey the lettered material part to the rewinding mechanism 3. When the lettering mechanism 2 is arranged on the working platform 41, the paper pulling assemblies 12 at the two ends of the working platform 41 can be utilized to simultaneously rotate forwards and backwards to realize the forward and backward movement of the material part, namely the movement of the material part in the Y-axis direction of the lettering position.

In the present embodiment, the paper feeding assembly 11 includes a paper feeding base 111, a material feeding shaft 112 and a paper pulling roller 114, wherein the material feeding shaft 112 and the paper pulling roller 114 are both arranged on the paper feeding base 111, and the material feeding shaft 112 and the paper pulling roller 114 are sequentially arranged to form a paper feeding path through which the material part passes.

In the present embodiment, the paper feeding base 111 is further provided with a deviation rectifying assembly 115 which is arranged between the material feeding shaft 112 and the paper pulling roller 114, and the deviation rectifying assembly 115 includes a deviation rectifying base 1151, a paper guiding frame 1152, a deviation rectifying motor 1153 and a deviation electric eye 1154, wherein the deviation rectifying base 1151 is fixed on the paper feeding base 111, the deviation rectifying motor 1153 and the deviation electric eye 1154 are both fixed on the deviation rectifying base 1151, the paper guiding frame 1152 is connected with the deviation rectifying motor 1153, the deviation electric eye 1154 senses the deviation signal of the material part, and the deviation electric eye 1154 and the deviation rectifying motor 1153 are both electrically connected with the control system.

In the present embodiment, the paper pulling assembly 12 includes a paper pulling side plate 121, main paper pulling rollers 122 and two paper pulling compression roller units 123, wherein the main paper pulling rollers 122 and the paper pulling compression roller units 123 are all fixed on the working platform 41 through the paper pulling side plate 121, and the paper pulling compression roller units 123 are movably connected with the main paper pulling rollers 122. The paper pulling assemblies 12 are correspondingly arranged on two sides of the working platform 41, when the material part is conveyed to the lettering position on the tool bit base 423, the lettering assembly 21 letters the conveyed material part, and the main paper pulling rollers 122 on the two sides simultaneously rotate forwards and backwards to control the material part to move left and right in the lettering position, namely, the main paper pulling rollers 122 can realize the forward and backward movement of the material part, and control the movement of the material part in the Y-axis direction, which is matched with the movement of the lettering assembly 21 in the X-axis and Z-axis directions to realize the lettering of complex patterns on the material part.

In the present embodiment, the paper pulling compression roller unit 123 includes a paper compression roller 124, paper compression sliders 125, cylinders 126 and cylinder clamping blocks 127, wherein both ends of the paper compression roller 124 are provided with the paper compression slider 125, the cylinder 126 and the cylinder clamping block 127, the paper pulling side plate 121 is provided with a supporting groove 128 adapted to the paper compression slider 125, the paper compression sliders 125 are slidably connected with the paper pulling side plate 121, the cylinders 126 are fixedly connected with the cylinder clamping blocks 127, the cylinder clamping blocks 127 are fixed at the two ends of the paper compression roller 124, and the peripheral surface of the paper compression roller 124 is tightly attached to the peripheral surface of the main paper pulling roller 122 and forms the conveying path of the material part. When the cylinders 126 drive the cylinder clamping blocks 127 to extend out, the paper compression sliders 125 are driven to slide in the supporting groove 128, and the paper compression roller 124 is further driven to push toward the main paper pulling roller 122, so that the paper compression roller 124 and the main paper pulling roller 122 are pressed tightly; when the cylinders 126 drive the cylinder clamping blocks 127 to retract, the paper compression roller 124 is separated from the main paper pulling roller 122.

In the present embodiment, the conveying mechanism 1 further includes a paper feeding mechanism 13 for tensioning the material part, the paper feeding mechanism 13 is electrically connected to the control system, and includes a front side plate 131, a rear side plate 132, a first paper guiding roller 133, a second paper guiding roller 134, a third paper guiding roller 135, first buffer sliding bases 136 and a buffer driving assembly 137, wherein the first buffer sliding bases 136 are connected to the buffer driving assembly 137, the first paper guiding roller 133 and the second paper guiding roller 134 are both fixed on the upper portions of the front side plate 131 and the rear side plate 132, both the lower portion of the front side plate 131 and the lower portion of the rear side plate 132 are provided with the first buffer sliding base 136, the two ends of the third paper guiding roller 135 are respectively slidably connected to the front side plate 131 and the rear side plate 132 through the first buffer sliding bases 136, and the first paper guiding roller 133, the third paper guiding roller 135 and the second paper guiding roller 134 sequentially form a conveying channel of the material path. Preferably, the paper feeding mechanism 13 is arranged between the paper feeding assembly 11 and the paper pulling assembly 12 and/or between the paper pulling assembly 12 and the rewinding mechanism 3, and the buffer driving assembly 137 controls the first buffer sliding bases 136 to slide up and down along the front side plate 131 and the rear side plate 132 to drive the third paper guiding roller 135 to move up and down, the first buffer sliding base 136 and the third paper guiding roller 135 move up along with the consumption of the material part, and the first buffer slide 136 and the third paper guiding roller 135 move down along with the supplement of the material part, and the material part passing through the third paper guiding roller 135 is in a tensioned state by the up and down movement of the third paper guiding roller 135.

In the present embodiment, the front side plate 131 and the rear side plate 132 are fixedly provided with at least one position sensor 138 for sensing the positions of the first buffer sliding bases 136, and the position sensors 138 are electrically connected to the control system. The position sensors 138 are known in the art and may be linear displacement sensors or other sensors. Preferably, each first buffer sliding base 136 is provided with a vertical sensing piece which is adapted to one position sensor 138, so that the sensing piece on each first buffer sliding base 136 can be ascended or descended within the sensing range of the position sensor 138, which is beneficial to controlling the conveying speed of the material part, and effectively prevents the material part from being damaged due to the excessive descending or ascending of the first buffer sliding bases 136.

In the present embodiment, the buffer driving assembly 137 includes a buffer motor 1371, a first transmission shaft 1372, a second transmission shaft 1373, a synchronizing belt 1374 and synchronizing wheels 1375, wherein both ends of the first transmission shaft 1372 and both ends of the second transmission shaft 1373 are provided with the synchronizing wheels 1375, the buffer motor 371 is connected with the first transmission shaft 1372, the two ends of the first transmission shaft 1372 are respectively fixed in the upper portion of the front side plate 131 and the upper portion of the rear side plate 132, the two ends of the second transmission shaft are respectively fixed in the lower portion of the front side plate and the lower portion of the rear side plate, the synchronizing wheel 1375 of the first transmission shaft 1372 and the synchronizing wheel 1375 of the second transmission shaft 1373 on the same side are connected through the synchronizing belt 1374, and the first buffer sliding bases 136 are fixedly connected with the synchronizing belt 1374. The buffer motor 1371 drives the first transmission shaft 1372 to rotate forward and backward, and the synchronizing belt 1374 rotates to drive the first buffer sliding base 136 to ascend or descend, so as to drive the third paper guiding roller 135 to ascend or descend, thereby performing a paper feeding operation.

In the present embodiment, the rewinding mechanism 3 includes a rewinding base 31, a stripping assembly 32, a waste collecting shaft 33, and a material collecting shaft 34, wherein the stripping assembly 32, the waste collecting shaft 33, and the material collecting shaft 34 are all arranged on the rewinding base 31, the stripping assembly 32 includes a first stripping roller 321 and a second stripping roller 322, the second stripping roller 322 is arranged above the first stripping roller 321, the peripheral surface of the second stripping roller 322 is tightly attached to the peripheral surface of the first stripping roller 321, and the finished product is wound on the material collecting shaft 34 and the waste product is wound on the waste collecting shaft 33 after the material part passing through the stripping assembly 32. The processed material part is separated into a product and a waste product through the stripping assembly 32, and the product and the waste product are automatically respectively would up and cleaned up by using the setting of the material collecting shaft 34 and the waste collecting shaft 33, so that the lettering processing efficiency is improved.

In the present embodiment, the rewinding base is provided with a paper cutting traction assembly 35 which is arranged on the right side of the rewinding base 31, wherein the paper cutting traction assembly 35 comprises a traction roller 351, a traction roller compression roller 352 and a paper cutting assembly 353, the peripheral surface of the traction roller 351 is tightly attached to the peripheral surface of the traction roller compression roller 352, and a material part conveying path is formed between the traction roller 351 and the traction roller compression roller 352 and used for conveying the material part into the paper cutting assembly 353. Specifically, the paper cutting assembly 353 is a prior art paper cutter, and the paper cutting operation can be achieved by pulling the material part into the paper cutter by the traction roller 351. When the material part after lettering does not need to be transversely cut off, the finished product and the waste product of the material part can be collected in a rewinding way by utilizing the material collecting shaft 34 and the waste collecting shaft 33; when the material part after lettering needs to be transversely cut off, the combination of the waste collecting shaft 33 and the traction roller 351 can be utilized to pull the finished product part into the paper cutting assembly 353, namely the transverse cutting of the finished product is finished.

Second Embodiment: Referring to FIGS. 14-27

An energy-saving and environment-friendly digital lettering machine, which comprises a conveying mechanism 5, a rewinding mechanism 7 and a machine base 8, wherein the machine base is provided with a working platform 81, and the conveying mechanism 5 and the rewinding mechanism 7 are respectively arranged on the left side and the right side of the working platform 81, is characterized in that the lettering machine further comprises a lettering mechanism 6 which is arranged on the working platform 81, the lettering mechanism 6 is arranged on the working platform 81 through a corresponding mounting base 82, and the conveying mechanism 5, the lettering mechanism 6 and the rewinding mechanism 7 are all electrically connected with a control system (not shown); the lettering mechanism 6 comprises a lettering assembly 61, an X-axis moving assembly 62 and a Z-axis moving assembly 63, wherein the lettering assembly 61 is fixedly arranged on the Z-axis moving assembly 63, the lettering assembly 61 slides up and down on the Z-axis moving assembly 63, the Z-axis moving assembly 63 is fixedly arranged on the X-axis moving assembly 62, and the Z-axis moving assembly 63 and the lettering assembly 61 synchronously slide on the X-axis moving assembly 62.

In the present application document, in the horizontal plane, the direction perpendicular to the conveying direction of the material part is the X-axis direction, and the conveying direction of the material part is the Y-axis direction, and the vertical direction is the Z-axis direction. The pattern files required to be produced are introduced into the control system, the control system controls the conveying mechanism 5 to convey the material part to the lettering mechanism 6, wherein the conveying mechanism 5 can realize the forward and backward movement of the material part, thereby controlling the movement of the material part in the Y-axis direction, which is matched with the movement of the lettering assembly 61 in the X-axis and Z-axis directions, the X-axis moving assembly 62 controls the Z-axis moving assembly 63 and the lettering assembly 61 to slide in the X-axis direction, the Z-axis moving assembly 63 controls the lettering assembly 61 to ascend and descend in the Z-axis direction, thereby controlling the lettering depth of the material part by the lettering assembly 61 and further controlling the lettering assembly 61 to engrave various patterns of the material part, and the rewinding mechanism 7 receives and discharges the processed material part to meet the production requirement; meanwhile, the feeding direction of the existing conveying mechanism is used as a movement control direction of the lettering assembly, so that the mechanism of the existing lettering machine can be fully utilized, the mechanism setting is simplified, and the manufacturing cost is reduced.

In the present embodiment, the mounting base 82 and the X-axis moving assembly 62 are fixedly connected, the mounting base 82 is provided with a channel for conveying the material part, and the mounting base 82 includes a first mounting portion 821 and a second mounting portion 822, wherein the first mounting portion 821 is connected to the second mounting portion 822 at a certain angle to form an L-shaped structure, and a tool bit base 823 adapted to the lettering assembly 21 is provided on the second mounting portion 822.

In the present embodiment, the number of the lettering mechanism 6 is set to be two or more, wherein at least one lettering mechanism 6 is fixed on the working platform 81, at least one lettering mechanism 6 is slidably connected with the working platform 81 through a sliding assembly 64, and each lettering mechanism is arranged side by side in the Y-axis direction. When the number of the lettering mechanisms 6 is two or more, each lettering mechanism 6 indirectly processes the material part, the material part where the former lettering mechanism 6 does not process is processed by the latter lettering mechanism 6, and the plurality of lettering mechanisms 6 cooperate with each other, so that lettering can be completed on the whole coil material part, and the lettering efficiency can be further improved.

In the present embodiment, the sliding assembly 64 is fixedly arranged on the working platform 81, the sliding assembly 64 is electrically connected to the control system, the sliding assembly 64 includes a sliding base 641 and a first driving unit 642, the sliding base 641 is connected to the first driving unit 642, and the sliding base 641 is fixedly connected to the mounting base 82.

In the embodiment, the first driving unit 642 includes a first screw rod 643 and a first motor 644, the bottom of the sliding base 641 is provided with a nut connecting seat 645 which is sleeved on the first screw rod 643, and the first screw rod 643 is connected with the first motor 644. The control system drives the first screw rod 643 to rotate by using the first motor 644, and the first screw rod 643 drives the sliding base 641 to slide on the first screw rod 643 through the nut connecting seat 645, so as to drive the mounting base 82 and the second lettering mechanism 65 to slide on the working platform 81. In case of using the combination of the motor and the screw rod to control the movement of the sliding base 641 on the working platform 81, the structure is simple and easy to control.

In the present embodiment, the X-axis moving assembly 62 includes a first base 621, a second driving unit 622 and a first sliding plate 623, wherein the second driving unit 622 and the first sliding plate 623 are both arranged on the first base 621, the first base 621 is fixedly connected to the mounting base 82, the first base 621 is provided with a first sliding rail 624 for the first sliding plate 623 to slide, the first sliding plate 623 is fixedly connected to the Z-axis moving assembly 63, and the first sliding plate 623 is connected to the second driving unit 622. The second driving unit 622 drives the first sliding plate 623 to move along the first sliding rail 624 in the X-axis direction, and further drives the Z-axis moving assembly 63 on the first sliding plate 623 to slide in the X-axis direction.

In the present embodiment, the shortest edge of the first base 621 is vertically arranged on the mounting base 82, and the second driving unit 622 includes a second motor 6221 and a second screw rod 6222, wherein the second motor 6221 is connected to the second screw rod 6222, and the second screw rod 6222 is slidably connected to the first sliding plate 623. Preferably, the second motor 6221 uses an absolute value encoder, which is a prior art. Compared with the horizontal arrangement of the first base 621, when the first base 621 is vertically arranged, the occupied area of the first base 621 can be greatly reduced, namely the mounting area of the X-axis moving assembly 62 on the working platform 81 is reduced, thereby facilitating the arrangement of the plurality of lettering mechanisms 6 on the working platform 81, and simultaneously facilitating the decrease-ment of the occupied area of the lettering machine.

In the present embodiment, the Z-axis moving assembly 63 includes a second base 631, a third motor 632 and a third screw rod 633, wherein the third motor 632 and the third screw rod 633 are both arranged on the second base 631, the second base 631 is provided with a second sliding rail 634, the third screw rod 633 and the second sliding rail 634 are arranged in parallel in a vertical direction, the third screw rod 633 and the third motor 632 are connected, the second base 631 is fixedly connected to the X-axis moving assembly 62, and the third screw rod 633 and the second sliding rail 634 are both slidably connected to the lettering assembly 61. Preferably, the third motor 632 also employs an absolute value encoder in the prior art, the third motor 632 drives the third screw rod 633 to rotate, and the third screw rod 633 rotates to drive the lettering assembly 61 to move up and down along the second sliding rail 634 in the Z-axis direction.

In the present embodiment, the second base 631 is provided with a plurality of lifting buffer springs 635, one end of each lifting buffer spring 635 is fixedly connected to the second base 631, and the other end of each lifting buffer spring 635 is fixedly connected to the lettering assembly 61. During the up-and-down lifting process of the lettering assembly 61, the setting of the lifting buffer spring 635 can play a role in buffer, so that the speed of the lettering assembly 61 in ascending and descending is prevented from being too fast.

In the present embodiment, the second base 631 is further provided with a color mark sensor 636, and the color mark sensor 636 is electrically connected to the control system. The color mark sensor 636 is a prior art, and is used for searching for pattern MARK points on the edge of the material part, and transmitting the signal to the control system for processing, so that the control system can control the lettering assembly 61 to carry out lettering operation on the material part.

In the present embodiment, the lettering assembly 61 includes a third base 611 and one or more tool aprons 612, wherein the third base 611 is slidably connected to the Z-axis moving assembly 23, the tool apron 612 is arranged on the third base 611, and the tool apron 612 is provided with a cutting tool 613 which is corresponding to the tool bit base 823 on the mounting base 42.

In the present embodiment, the third base 611 is provided with a third sliding rail 616 which is horizontally arranged along the X-axis direction, when the third base 611 is provided with two or more tool aprons 612, at least one tool apron 612 is arranged on the third sliding rail 616, and each tool apron 612 arranged on the third sliding rail 616 is connected to a fourth screw rod 614 and a fourth motor 615 which correspond to the tool aprons. When the third base 611 is provided with two or more tool aprons 612, the tool aprons 612 arranged on the third sliding rail 616 are all connected to the fourth screw rod 614 and the fourth motor 615 which correspond to the tool aprons, so that the fourth motor 615 drives the tool aprons 612 to slide in the horizontal direction along the fourth screw rod 614 and the third sliding rail 616, and the distance between the multiple tool aprons 612 can be adjusted to adapt to the lettering pattern of the material part, meanwhile, the processing efficiency of the lettering assembly 61 is further improved.

In the present embodiment, the conveying mechanism 5 includes a paper feeding assembly 51 and paper pulling assemblies 52, the paper feeding assembly 51 is arranged on the left side of the working platform 81, both ends of the working platform 81 are provided with the paper pulling assembly 52, the paper feeding assembly 51 conveys the material part to the paper pulling assemblies 52 after unwinding the material part, the paper pulling assemblies 52 convey the material part to the working platform 81 and convey the lettered material part to the rewinding mechanism 7. When the lettering mechanism 6 is arranged on the working platform 81, the paper pulling assemblies 52 at the two ends of the working platform 81 can be utilized to simultaneously rotate forwards and backwards to realize the forward and backward movement of the material part, namely the movement of the material part in the Y-axis direction of the lettering position.

In the present embodiment, the paper feeding assembly 51 includes a paper feeding base 511, a material feeding shaft 512 and a paper pulling roller 514, wherein the material feeding shaft 512 and the paper pulling roller 514 are both arranged on the paper feeding base 511, and the material feeding shaft 512 and the paper pulling roller 514 are sequentially arranged to form a paper feeding path through which the material part passes.

In the present embodiment, the paper feeding base 511 is further provided with a deviation rectifying assembly 515 which is arranged between the material feeding shaft 512 and the paper pulling roller 514, and the deviation rectifying assembly 515 includes a deviation rectifying base 5151, a paper guiding frame 5152, a deviation rectifying motor 5153 and a deviation electric eye 5154, wherein the deviation rectifying base 5151 is fixed on the paper feeding base 511, the deviation rectifying motor 5153 and the deviation electric eye 5154 are both fixed on the deviation rectifying base 5151, the paper guiding frame 5152 is connected with the deviation rectifying motor 5153, the straight line where the output shaft of the deviation rectifying motor 5153 is located is perpendicular to the straight line where the axis of the paper guiding frame 5152 is located, the deviation electric eye 5154 senses the deviation signal of the material part, and the deviation electric eye 5154 and the deviation rectifying motor 5153 are both electrically connected with the control system.

In the present embodiment, the paper pulling assembly 52 includes a paper pulling side plate 521, main paper pulling rollers 522 and two paper pulling compression roller units 523, wherein the main paper pulling rollers 522 and the paper pulling compression roller units 523 are all fixed on the working platform 81 through the paper pulling side plate 521, and the paper pulling compression roller units 523 are movably connected with the main paper pulling rollers 522. The paper pulling assemblies 52 are correspondingly arranged on two sides of the working platform 81, when the material part is conveyed to the lettering position on the tool bit base 823, the lettering assembly 61 letters the conveyed material part, and the main paper pulling rollers 522 on the two sides simultaneously rotate forwards and backwards to control the material part to move left and right in the lettering position, namely, the main paper pulling rollers 522 can realize the forward and backward movement of the material part, and control the movement of the material part in the Y-axis direction, which is matched with the movement of the lettering assembly 61 in the X-axis and Z-axis directions to realize the lettering of complex patterns on the material part.

In the present embodiment, the paper pulling compression roller unit 523 includes a paper compression roller 524, paper compression sliders 525, cylinders 526 and cylinder clamping blocks 527, wherein both ends of the paper compression roller 524 are provided with the paper compression slider 525, the cylinder 526 and the cylinder clamping block 527, the paper pulling side plate 521 is provided with a supporting groove 528 adapted to the paper compression slider 125, the paper compression sliders 525 are slidably connected with the paper pulling side plate 521, the cylinders 526 are fixedly connected with the cylinder clamping blocks 527, the cylinder clamping blocks 527 is fixed at the two ends of the paper compression roller 524, and the peripheral surface of the paper compression roller 524 is tightly attached to the peripheral surface of the main paper pulling roller 522 and forms the conveying path of the material part. When the cylinder 526 drive the cylinder clamping blocks 527 to extend out, the paper compression sliders 525 are driven to slide in the supporting groove 528, and the paper compression roller 524 is further driven to push toward the main paper pulling roller 522, so that the paper compression roller 524 and the main paper pulling roller 522 are pressed tightly; when the cylinders 526 drive the cylinder clamping blocks 527 to retract, the paper compression roller 524 is separated from the main paper pulling roller 522.

In the present embodiment, the conveying mechanism 5 further includes a paper feeding mechanism 53 for tensioning the material part, the paper feeding mechanism 53 is electrically connected to the control system, and includes a front side plate 531, a rear side plate 532, a first paper guiding roller 533, a second paper guiding roller 534, a third paper guiding roller 535, first buffer sliding bases 536 and a buffer driving assembly 537, wherein the first buffer sliding bases 536 are connected to the buffer driving assembly 537, the first paper guiding roller 533 and the second paper guiding roller 534 are both fixed on the upper portions of the front side plate 531 and the rear side plate 532, both the lower portion of the front side plate 531 and the lower portion of the rear side plate 532 are provided with the first buffer sliding base 536, the two ends of the third paper guiding roller 535 are respectively slidably connected to the front side plate 531 and the rear side plate 532 through the first buffer sliding bases 536, and the first paper guiding roller 533, the third paper guiding roller 535 and the second paper guiding roller 534 sequentially form a conveying channel of the material path. Preferably, the paper feeding mechanism 53 is arranged between the paper feeding assembly 51 and the paper pulling assembly 52 and/or between the paper pulling assembly 52 and the rewinding mechanism 7, and the buffer driving assembly 537 controls the first buffer sliding bases 536 to slide up and down along the front side plate 531 and the rear side plate 532 to drive the third paper guiding roller 535 to move up and down, the first buffer sliding base 536 and the third paper guiding roller 535 move up along with the consumption of the material part, and the first buffer sliding base 536 and the third paper guiding roller 535 move down along with the supplement of the material part, and the material part passing through the third paper guiding roller 535 is in a tensioned state by the up and down movement of the third paper guiding roller 535.

In the present embodiment, the front side plate 531 and the rear side plate 532 are fixedly provided with at least one position sensor 538 for sensing the positions of the first buffer sliding bases 536, and the position sensors 538 are electrically connected to the control system. The position sensors 538 are known in the art and may be linear displacement sensors or other sensors. Preferably, each first buffer sliding base 536 is provided with a vertical sensing piece which is adapted to one position sensor 538, so that the sensing piece on each first buffer sliding base 536 can be ascended or descended within the sensing range of the position sensor 538, which is beneficial to controlling the conveying speed of the material part, and effectively prevents the material from being damaged due to the excessive descending or ascending of the first buffer sliding bases 536.

In the present embodiment, the buffer driving assembly 537 includes first extension springs 5371, anti-collision blocks 5372 and first linear guiding rails 5373, both the inner side of the front side plate 531 and the inner side of the rear side plate 532 are provided the first linear guiding rail 5373, the first linear guiding rails 5373 are arranged in the vertical direction, the ends of the first linear guiding rails 5373 are provided the anti-collision blocks 5372, one end of each first extension spring 5371 is fixedly arranged on one first buffer sliding base 536, the other end of the first extension spring 5371 is fixedly arranged on the front side plate 531 or the rear side plate 532, and the first buffer sliding bases 536 move up and down along the first linear guiding rails 5373. By providing the first linear guiding rails 5373, the first buffer sliding bases 536 and the third paper guiding roller 535 slide up and down, the third paper guiding roller 535 is constantly subjected to the urging force of the first tension springs 5371, the material part is kept in a tensioned state, and the anti-collision blocks 5372 have anti-collision and limiting effect on the third paper guiding roller 535.

In the present embodiment, each first buffer sliding base 536 is further provided with a fourth paper guiding roller 5361 for strengthening the tension of the material part and increasing the paper feeding length, wherein the fourth paper guiding roller 5361 and the third paper guiding roller 535 are on the same horizontal line, and the upper portion of the front side plate 531 and the upper portion of the rear side plate 532 are further provided with a fifth paper guiding roller 5311, and the first paper guiding roller 533, the third paper guiding roller 535, the second paper guiding roller 534, the fourth paper guiding roller 5361 and the fifth paper guiding roller 5311 are sequentially arranged to form a paper feeding path through which the material part passes. The fourth paper guiding roller 5361 and the third paper guiding roller 535 slide synchronously, which increases the tightening operation of the material part, enhances the tightening state of the material part, and reduces the generation of defective products.

In the present embodiment, the paper feeding mechanism 53 further includes a buffer assembly 539 which is fixed on the top of the front side plate 531 and the top of the rear side plate 532, the buffer assembly 539 includes second linear guiding rails 5391, guiding rail sliders 5392, a second tension spring 5393 and a buffer paper guiding roller 5394, the front side plate 531 and the rear side plate 532 are both provided the second linear guiding rail 5391, the second linear guiding rails 5391 are horizontally arranged, the two ends of the buffer paper guiding roller 5394 are both fixedly provided with the guiding rail slider 5392, each guiding rail slider 5392 is slidably connected with one second linear guiding rail 5391, one end of the second tension spring 5393 is fixedly connected with the guiding rail sliders 5392, and the other end of the second tension spring 5393 is fixedly connected with the front side plate 531 or the rear side plate. The tops of the front side plate 531 and the rear side plate 532 are provided with a buffer assembly 539, and the buffer paper guiding roller 5394 moves left and right in the horizontal direction to adjust the vertical lifting speed of the first buffer sliding base 536, thereby adjusting the material part conveying speed and the tension of the material part. Specifically, when the buffer paper guiding roller 5394 moves slowly rightward, the first buffer sliding bases 536 also move slowly upward, and when the buffer paper guiding roller 5394 moves to the rightmost end, the first buffer sliding bases 536 move up at the fastest speed; when the buffer paper guiding roller 5394 moves slowly leftward, the first buffer sliding bases 536 also move slowly downward, and when the buffer paper guiding roller 5394 moves to the leftmost end, the first buffer sliding bases 536 move down at the fastest speed.

In the present embodiment, the rewinding mechanism 7 includes a rewinding base 71, a stripping assembly 72, a waste collecting shaft 73, and a material collecting shaft 74, wherein the stripping assembly 72, the waste collecting shaft 73, and the material collecting shaft 74 are all arranged on the rewinding base 71, the stripping assembly 72 includes a first stripping roller 721 and a second stripping roller 722, the second stripping roller 722 is arranged above the first stripping roller 721, the peripheral surface of the second stripping roller 722 is tightly attached to the peripheral surface of the first stripping roller 721, and the finished product is wound on the material collecting shaft 74 and the waste product is wound on the waste collecting shaft 73 after the material part passing through the stripping assembly 72. The processed material part is separated into a product and a waste product through the stripping assembly 72, and the product and the waste product are automatically respectively would up and cleaned up by using the setting of the material collecting shaft 74 and the waste collecting shaft 7, so that the lettering processing efficiency is improved.

In the present embodiment, the rewinding base is provided with a paper cutting traction assembly 75 which is arranged on the right side of the rewinding base 71, wherein the paper cutting traction assembly 75 comprises a traction roller 751, a traction roller compression roller 752 and a paper cutting assembly 753, the peripheral surface of the traction roller 751 is tightly attached to the peripheral surface of the traction roller compression roller 752, and a material part conveying path is formed between the traction roller 751 and the traction roller compression roller 752 and used for conveying the material part into the paper cutting assembly 753. Specifically, the paper cutting assembly 753 is a prior art paper cutter, and the paper cutting operation can be achieved by pulling the material part into the paper cutter by the traction roller 751. When the material part after lettering does not need to be transversely cut off, the finished product and the waste product of the material part can be collected in a rewinding way by utilizing the material collecting shaft 74 and the waste collecting shaft 73; when the material part after lettering needs to be transversely cut off, the combination of the waste collecting shaft 73 and the traction roller 751 can be utilized to pull the finished product part into the paper cutting assembly 753, namely the transverse cutting of the finished product is finished.

Figure 28:
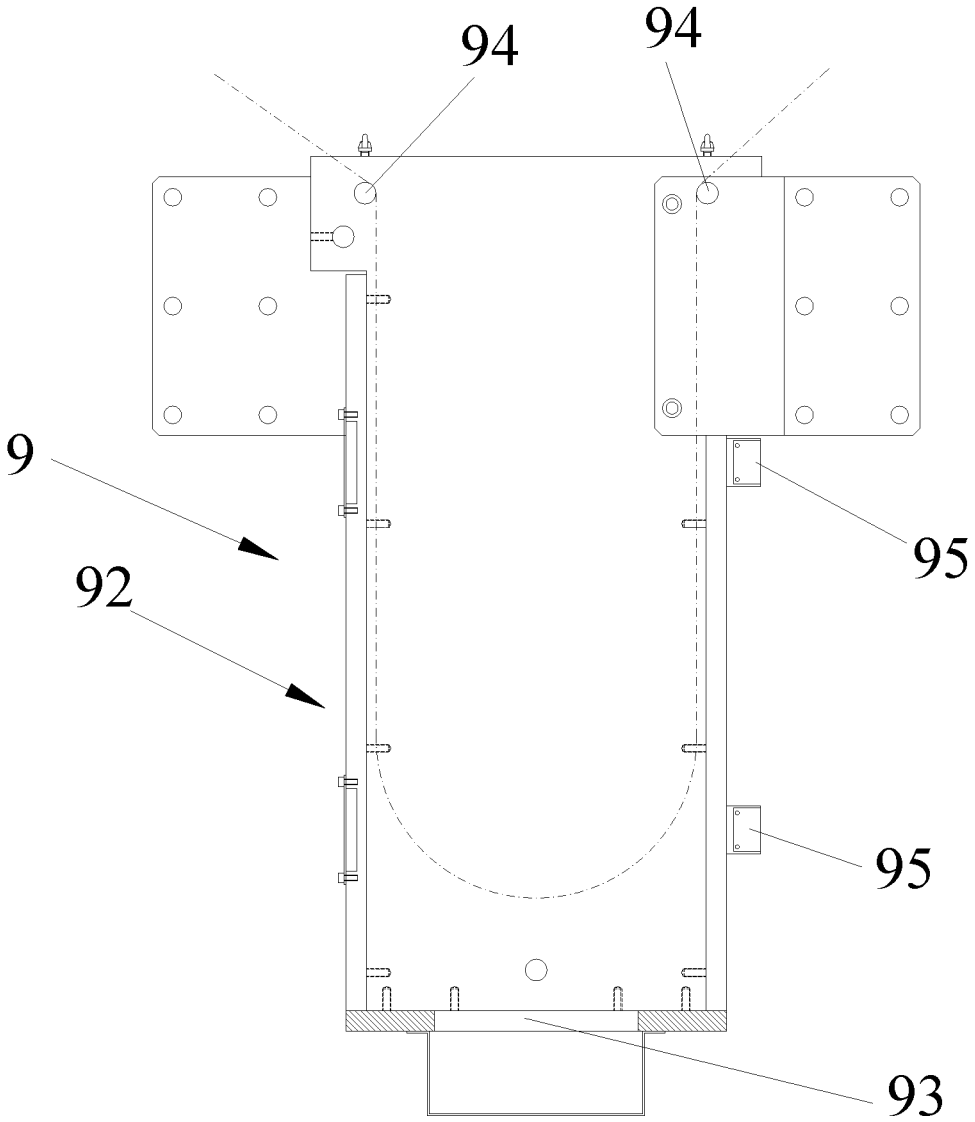
FIG. 28 is a main view of the tension bellows used to replace the paper feeding mechanism in the first and second embodiments in the present invention.
Figure 29:
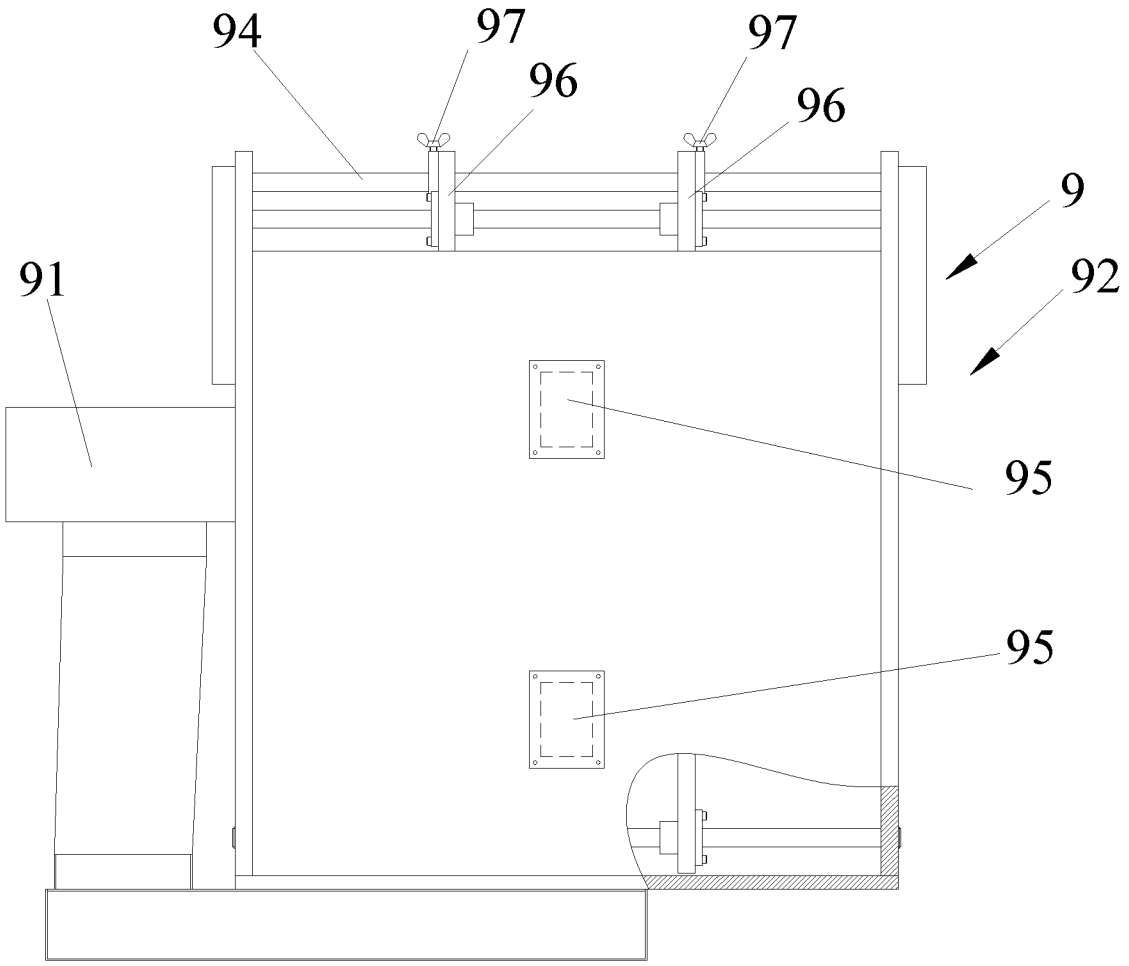
FIG. 29 is a left side view of the tension bellows used to replace the paper feeding mechanism in the first and second embodiments in the present invention.

Referring to FIGS. 28 and 29, in the first and second embodiments described above, the paper feeding mechanism may be replaced with a tension bellows. The tension bellows is electrically connected with the control system and is arranged between the paper feeding assembly and the paper pulling assembly or between the paper pulling assembly and the rewinding mechanism.

The tension bellows 9 includes a fan 91 and a bellows body 92, wherein the bottom of the bellows body 92 is provided with a wind gap 93, the fan 91 is communicated with the bellows body 92 through the wind gap 93, the opening of bellows body 92 faces upwards and both the left and right sides at the top are provided with a bellows paper guiding roller 94 that is used for the material part to pass into and out of the bellows body 92, and the bellows body 92 is provided with a height sensor 95 that is used for sensing to the height of the material part. When using the tension bellows 9, the material part enters the interior from one side of the bellows body 92 and then comes out from the other side, and when the material part is in the interior of the tension bellows 9, the fan 91 acts on the bellows body 92 to pump out the lower air enclosed by the material part and the bellows body 92, new air is compensated from the gap position to form air flow, and the material part can be tightened by the air flow formed by the fact that the air pressure at the upper part of the material part is larger than that at the lower part of the material part. The height sensor 95 is a prior art, and specifically, a high-position sensor and a low-position sensor can be arranged on the bellows body 92, the position of the material part is sensed through the height sensor 95, a signal is correspondingly sent to the control system, and the control system controls the feeding or discharging operation of the tension bellows.

The bellows paper guiding roller 94 on each side is sleeved with two bellows sliding plates 96, the material part passes through the bellows paper guiding roller 94 and is limited between the bellows sliding plates 96 on each side, the bellows sliding plates 96 are slidably connected with the bellows paper guiding roller 94, and each bellows sliding plate 96 is provided with corresponding fastening bolts 97. The bellows sliding plates 96 are sleeved on the bellows paper guiding rollers 94, and the distance between the bellows sliding plates 96 on each side can be adjusted by using the fastening bolts 97, so that the bellows sliding plates 96 can be fixed without sliding when in use, material part cannot be clamped and damaged, and the widths of different material part can be adapted.

The present invention has the advantages that the equipment combines the X-axis moving assembly, the Z-axis moving assembly and the lettering assembly, and the lettering assembly can move in the horizontal direction and the vertical direction, so that patterns on the material part can be engraved by the lettering cutter, the production of products with variable contents under actual conditions can be met without replacing the die cutting tool, and the production cost is reduced.

By using the equipment, the links of die cutting tool production and debugging machines are omitted, the generation of waste products is reduced, the energy is saved, and the environmental protection is facilitated; and the equipment has high automation degree, simple operation, quick stencil change and good use effect, and is suitable for the production requirement of small batch.

The above is only a preferred embodiment of the present invention, but the present invention is not limited thereto, and any modifications that can be conceived by those skilled in the art are intended to fall within the scope of the present invention.

What is claimed is:

1. An energy-saving environment-friendly digital lettering machine, which comprises a conveying mechanism, a rewinding mechanism and a machine base, wherein the machine base is provided with a working platform, and the conveying mechanism and the rewinding mechanism are respectively arranged on a left side and a right side of the working platform, wherein the lettering machine further comprises a lettering mechanism, the working platform is provided with at least one lettering mechanism, and each lettering mechanism is arranged on the working platform through a corresponding mounting base, wherein the conveying mechanism, the lettering mechanism and the rewinding mechanism are all electrically connected with a control system of the lettering machine;

each lettering mechanism comprises a lettering assembly, an X-axis moving assembly and a Z-axis moving assembly, wherein the lettering assembly realizes engraving of patterns, and the lettering assembly is arranged on the X-axis moving assembly and supported by the Z-axis moving assembly;

wherein the conveying mechanism comprises a paper feeding assembly and two paper pulling assemblies;

wherein the paper feeding assembly comprises a paper feeding base; a material feeding shaft; and a paper pulling roller, wherein the material feeding shaft and the paper pulling roller are both arranged on the paper feeding base, and the material feeding shaft and the paper pulling roller are sequentially arranged to form a paper feeding path through which a material piece passes;

wherein each paper pulling assembly comprises two paper pulling side plates; a main paper pulling roller; and two paper pulling compression roller units, wherein the main paper pulling roller and the paper pulling compression roller units are all fixed on the working platform through the paper pulling side plates, and the paper pulling compression roller units are movably connected with the main paper pulling roller;

wherein each paper pulling compression roller unit comprises a paper compression roller; two paper compression sliders; two cylinders; and two cylinder clamping blocks, wherein two ends of the paper compression roller are respectively provided with the two paper compression sliders, the two cylinders and the two cylinder clamping blocks, the paper pulling side plates each being provided with a supporting groove fitted to a respective one of the paper compression sliders, the paper compression sliders are slidably connected with the paper pulling side plates, the cylinders are fixedly connected with the cylinder clamping blocks, the two cylinder clamping blocks are fixed at the two ends of the paper compression roller respectively, and a peripheral surface of the paper compression roller is pressed against a peripheral surface of the main paper pulling roller to form a conveying path of the material piece;

wherein the rewinding mechanism comprises a rewinding base; a stripping assembly; a waste collecting shaft; and a material collecting shaft, wherein the stripping assembly, the waste collecting shaft, and the material collecting shaft are all arranged on the rewinding base, the stripping assembly includes a first stripping roller and a second stripping roller, the second stripping roller is arranged above the first stripping roller, a peripheral surface of the second stripping roller is pressed against a peripheral surface of the first stripping roller, and a finished product is wound on the material collecting shaft and a waste product is wound on the waste collecting shaft after the material piece passes through the stripping assembly;

wherein the X-axis moving assembly is a linear motor, and the Z-axis moving assembly comprises a base; a motor; and a screw rod, wherein the motor and the screw rod are arranged on the base, the base is provided with a sliding rail, the screw rod and the sliding rail are arranged in parallel in a vertical direction, the screw rod and the motor are connected, the base is fixedly connected with the X-axis moving assembly, and the screw rod and the sliding rail are slidably connected with the lettering assembly.

2. The energy-saving environment-friendly digital lettering machine according to claim 1, wherein the lettering assembly is arranged on the Z-axis moving assembly, the lettering assembly slides up and down on the Z-axis moving assembly, the Z-axis moving assembly is arranged on the X-axis moving assembly, and the Z-axis moving assembly and the lettering assembly slide together on the X-axis moving assembly.

3. The energy-saving environment-friendly digital lettering machine according to claim 1, characterized in that the mounting base and the X-axis moving assembly are fixedly connected, the mounting base is provided with a channel for conveying the material part, and the mounting base includes a first mounting portion and a second mounting portion, wherein the first mounting portion is connected to the second mounting portion at a certain angle to form an L-shaped structure, and a tool bit base adapted to the lettering assembly is provided on the second mounting portion.

4. The energy-saving environment-friendly digital lettering machine according to claim 1, characterized in that the number of the lettering mechanism is set to be one, and the lettering mechanism is fixedly provided on the working platform through the corresponding mounting base, or the lettering mechanism is slidably connected with the working platform through a sliding assembly.

5. The energy-saving environment-friendly digital lettering machine according to claim 1, characterized in that when the number of the lettering mechanisms is set to be two or more, at least one lettering mechanism is fixed on the working platform, and at least one lettering mechanism is slidably connected with the working platform through a sliding assembly, and each lettering mechanisms is arranged side by side in the Y-axis direction.

6. The energy-saving environment-friendly digital lettering machine according to claim 1, characterized in that when the number of the lettering mechanisms is set to be two or more, the lettering mechanisms are all movably arranged on the working platform through a sliding assembly, and each lettering mechanism is arranged side by side in the Y-axis direction.

7. The energy-saving environment-friendly digital lettering machine according to claim 1, characterized in that when the number of the lettering mechanisms is set to be two or more, the lettering mechanisms are fixedly arranged on the working platform, and each lettering mechanism is arranged side by side in the Y-axis direction.

8. The energy-saving environment-friendly digital lettering machine according to claim 4, characterized in that the sliding assembly is arranged on the working platform, the sliding assembly is electrically connected with the control system, and the sliding assembly comprises a sliding base and a first driving unit, wherein the sliding base is connected with the first driving unit, and the sliding base is fixedly connected with the mounting base.

9. The energy-saving environment-friendly digital lettering machine according to claim 8, characterized in that the first driving unit comprises a first screw rod and a first motor, the bottom of the sliding base is provided with a nut connecting seat which is sleeved on the first screw rod, and the first screw rod is connected with the first motor.

10. The energy-saving environment-friendly digital lettering machine according to claim 1, characterized in that the X-axis moving assembly is a linear motor which comprises a motor body and a rotor seat sliding on the motor body, and the rotor seat is fixedly connected with the Z-axis moving assembly.

11. The energy-saving environment-friendly digital lettering machine according to claim 1, characterized in that the X-axis moving assembly comprises a first base, a second driving unit and a first sliding plate, wherein the second driving unit and the first sliding plate are both arranged on the first base, the first base is fixedly connected with the mounting base, the first base is provided with a first sliding rail for the first sliding plate to slide, the first sliding plate is fixedly connected with the Z-axis moving assembly, and the first sliding plate is connected with the second driving unit.

12. The energy-saving environment-friendly digital lettering machine according to claim 11, characterized in that the shortest edge of the first sliding plate is vertically arranged on the mounting base, the second driving unit comprises a second motor and a second screw rod, the second motor is connected with the second screw rod, and the second screw rod is slidably connected with the first sliding plate.

13. The energy-saving environment-friendly digital lettering machine according to claim 1, characterized in that the Z-axis moving assembly comprises a second base, a third motor and a third screw rod, wherein the third motor and the third screw rod are arranged on the second base, the second base is provided with a second sliding rail, the third screw rod and the second sliding rail are arranged in parallel in the vertical direction, the third screw rod and the third motor are connected, the second base is fixedly connected with the X-axis assembly, and the third screw rod and the second sliding rail are slidably connected with the lettering assembly.

14. The energy-saving environment-friendly digital lettering machine according to claim 1, characterized in that the second base is provided with a plurality of lifting buffer springs, one end of each lifting buffer spring is fixedly connected with the second base, and the other end of each lifting buffer spring is fixedly connected with the lettering assembly.

15. The energy-saving environment-friendly digital lettering machine according to claim 14, characterized in that the second base is further provided with a color mark sensor, and the color mark sensor is electrically connected with the control system.

16. The energy-saving environment-friendly digital lettering machine according to claim 3, characterized in that the lettering assembly comprises a third base and one or more tool aprons, wherein the third base is slidably connected with the Z-axis moving assembly, the tool apron is arranged on the third base, the tool apron is provided with a cutting tool which is corresponding to the tool bit base on the mounting base.

17. The energy-saving environment-friendly digital lettering machine according to claim 16, characterized in that the third base is provided with a third sliding rail which is horizontally arranged along the X-axis direction, when the third base is provided with two or more tool aprons, at least one tool apron is arranged on the third sliding rail, and each tool apron arranged on the third sliding rail is connected with a fourth screw rod and a fourth motor which correspond to the tool apron.

18. The energy-saving environment-friendly digital lettering machine according to claim 1, wherein the paper feeding assembly is arranged on the left side of the working platform, the two paper pulling assemblies are provided at a left end and a right end of the working platform respectively, the paper feeding assembly conveys the material piece to the paper pulling assemblies after unwinding the material piece, the paper pulling assemblies convey the material piece to the working platform and convey the lettered material piece to the rewinding mechanism.

19. The energy-saving environment-friendly digital lettering machine according to claim 18, characterized in that the paper feeding assembly comprises a paper feeding base, a material feeding shaft and a paper pulling roller, wherein the material feeding shaft and the paper pulling roller are both arranged on the paper feeding base, and the material feeding shaft and the paper pulling roller are sequentially arranged to form a paper feeding path through which a material part passes.

20. The energy-saving environment-friendly digital lettering machine according to claim 19, characterized in that the paper feeding base is further provided with a deviation rectifying assembly which is arranged between the material feeding shaft and the paper pulling roller, and the deviation rectifying assembly includes a deviation rectifying base, a paper guiding frame, a deviation rectifying motor and a deviation electric eye, wherein the deviation rectifying base is fixed on the paper feeding base, the deviation rectifying motor and the deviation electric eye are both fixed on the deviation rectifying base, the paper guiding frame is connected with the deviation rectifying motor, the deviation electric eye senses the deviation signal of the material part, and the deviation electric eye and the deviation rectifying motor are both electrically connected with the control system.

21. The energy-saving environment-friendly digital lettering machine according to claim 18, characterized in that the paper pulling assembly includes a paper pulling side plate, a main paper pulling roller and two paper pulling compression roller units, wherein the main paper pulling roller and the paper pulling compression roller units are all fixed on the working platform through the paper pulling side plate, and the paper pulling compression roller units are movably connected with the main paper pulling roller.

22. The energy-saving environment-friendly digital lettering machine according to claim 21, characterized in that the paper pulling compression roller unit includes a paper compression roller, paper compression sliders, cylinders and cylinder clamping blocks, wherein both ends of the paper compression roller are provided with the paper compression slider, the cylinder and the cylinder clamping block, the paper pulling side plate is provided with a supporting groove adapted to the paper compression slider, the paper compression sliders are slidably connected with the paper pulling side plate, the cylinders are fixedly connected with the cylinder clamping blocks, the cylinder clamping blocks are fixed at the two ends of the paper compression roller, and the peripheral surface of the paper compression roller is tightly attached to the peripheral surface of the main paper pulling roller and forms the conveying path of the material part.

23. The energy-saving environment-friendly digital lettering machine according to claim 18, characterized in that the conveying mechanism further comprises a tension bellows used for tensioning the material part, wherein the tension bellows is electrically connected with the control system, and the tension bellows is arranged between the paper feeding assembly and the paper pulling assembly and/or between the paper pulling assembly and the rewinding mechanism.

24. The energy-saving environment-friendly digital lettering machine according to claim 23, characterized in that the tension bellows comprises a fan and a bellows body, wherein the bottom of the bellows body is provided with a wind gap, the fan is communicated with the bellows body through the wind gap, the opening of the bellows body faces upwards and both the left and right sides at the top are provided with a bellows paper guiding roller that is used for the material part to pass into and out of the bellows body, and the bellows body is provided with a height sensor that is used for sensing to the height of the material part.

25. The energy-saving environment-friendly digital lettering machine according to claim 24, characterized in that the bellows paper guiding roller on each side is sleeved with two bellows sliding plates, the material part passes through the bellows paper guiding roller and is limited between the bellows sliding plates on each side, the bellows sliding plates are slidably connected with the bellows paper guiding roller, and each bellows sliding plate is provided with corresponding fastening bolts.

26. The energy-saving environment-friendly digital lettering machine according to claim 18, characterized in that the conveying mechanism further comprises a paper feeding mechanism for tightening the material part, the paper feeding mechanism is electrically connected with the control system, and is arranged between the paper feeding assembly and the paper pulling assembly and/or between the paper pulling assembly and the rewinding mechanism.

27. The energy-saving environment-friendly digital lettering machine according to claim 26, characterized in that the paper feeding mechanism includes a front side plate, a rear side plate, a first paper guiding roller, a second paper guiding roller, a third paper guiding roller, first buffer sliding bases and a buffer driving assembly, wherein the first buffer sliding bases are connected to the buffer driving assembly, the first paper guiding roller and the second paper guiding roller are both fixed on the upper portions of the front side plate and the rear side plate, both the lower portion of the front side plate and the lower portion of the rear side plate are provided with the first buffer sliding base, the two ends of the third paper guiding roller are respectively slidably connected to the front side plate and the rear side plate through the first buffer sliding bases, and the first paper guiding roller, the third paper guiding roller and the second paper guiding roller sequentially form a conveying channel of the material part.

28. The energy-saving environment-friendly digital lettering machine according to claim 27, characterized in that the front side plate and the rear side plate are fixedly provided with at least one position sensor for sensing the positions of the first buffer sliding bases, and the position sensors are electrically connected to the control system.

29. The energy-saving environment-friendly digital lettering machine according to claim 27, characterized in that the buffer driving assembly includes a buffer motor, a first transmission shaft, a second transmission shaft, a synchronizing belt and synchronizing wheels, wherein both ends of the first transmission shaft and both ends of the second transmission shaft are provided with the synchronizing wheels, the buffer motor is connected with the first transmission shaft, the two ends of the first transmission shaft are respectively fixed in the upper portion of the front side plate and the upper portion of the rear side plate, the two ends of the second transmission shaft are respectively fixed in the lower portion of the front side plate and the lower portion of the rear side plate, the synchronizing wheel of the first transmission shaft and the synchronizing wheel of the second transmission shaft on the same side are connected through the synchronizing belt, and the first buffer sliding bases are fixedly connected with the synchronizing belt.

30. The energy-saving environment-friendly digital lettering machine according to claim 27, characterized in that the buffer driving assembly includes first extension springs, anti-collision blocks and first linear guiding rails, both the inner side of the front side plate and the inner side of the rear side plate are provided the first linear guiding rail, the first linear guiding rails are arranged in the vertical direction, the ends of the first linear guiding rails are provided the anti-collision blocks, one end of each first extension spring is fixedly arranged on one first buffer sliding base, the other end of the first extension spring is fixedly arranged on the front side plate or the rear side plate, and the first buffer sliding bases move up and down along the first linear guiding rails.

31. The energy-saving environment-friendly digital lettering machine according to claim 30, characterized in that each first buffer sliding base is further provided with a fourth paper guiding roller for strengthening the tension of the material part and increasing the paper feeding length, wherein the fourth paper guiding roller and the third paper guiding roller are on the same horizontal line, and the upper portion of the front side plate and the upper portion of the rear side plate are further provided with a fifth paper guiding roller, and the first paper guiding roller, the third paper guiding roller, the second paper guiding roller, the fourth paper guiding roller and the fifth paper guiding roller are sequentially arranged to form a paper feeding path through which the material part passes.

32. The energy-saving environment-friendly digital lettering machine according to claim 30, characterized in that the paper feeding mechanism further includes a buffer assembly which is fixed on the top of the front side plate and the top of the rear side plate, the buffer assembly includes buffer sliders, a buffer sliding unit and a buffer paper guiding roller, both ends of the buffer paper guiding roller are fixedly provided with the buffer slider, the buffer sliding unit is connected with the buffer sliders, and the buffer sliding unit drives the buffer paper guiding roller to move left and right through the buffer sliders.

33. The energy-saving environment-friendly digital lettering machine according to claim 32, characterized in that the buffer sliding unit comprises second linear guiding rails and a second extension spring, wherein the front side plate and the rear side plate are both provided with the second linear guiding rail, the second linear guiding rails are horizontally arranged along the Y-axis direction, the buffer sliders are arranged on the guiding rail sliders of the second linear guiding rails, one end of the second extension spring is fixedly connected with the buffer sliders, and the other end of the second extension spring is fixedly connected with the front side plate or the rear side plate.

34. The energy-saving environment-friendly digital lettering machine according to claim 32, characterized in that the buffer sliding unit comprises buffer guiding shafts, linear bearings and a buffer compression spring, wherein the front side plate and the rear side plate are both provided with the buffer guiding shaft, the buffer guiding shafts are horizontally arranged along the Y-axis direction, the buffer sliders are sleeved on the buffer guiding shafts through the linear bearings, one end of the buffer compression spring is fixedly connected with the buffer sliders, and the other end of the buffer compression spring is abutted against the front side plate or the rear side plate.

35. The energy-saving environment-friendly digital lettering machine according to claim 1, characterized in that the rewinding mechanism includes a rewinding base, a stripping assembly, a waste collecting shaft, and a material collecting shaft, wherein the stripping assembly, the waste collecting shaft, and the material collecting shaft are all arranged on the rewinding base, the stripping assembly includes a first stripping roller and a second stripping roller, the second stripping roller is arranged above the first stripping roller, the peripheral surface of the second stripping roller is tightly attached to the peripheral surface of the first stripping roller, and the finished product is wound on the material collecting shaft and the waste product is wound on the waste collecting shaft after the material part passing through the stripping assembly.

36. The energy-saving environment-friendly digital lettering machine according to claim 35, characterized in that the rewinding base is provided with a paper cutting traction assembly which is arranged on the right side of the rewinding base, wherein the paper cutting traction assembly comprises a traction roller, a traction roller compression roller and a paper cutting assembly, the peripheral surface of the traction roller is tightly attached to the peripheral surface of the traction roller compression roller, and a material part conveying path is formed between the traction roller and the traction roller compression roller and used for conveying the material part into the paper cutting assembly.

37. The energy-saving environment-friendly digital lettering machine according to claim 5, characterized in that the sliding assembly is arranged on the working platform, the sliding assembly is electrically connected with the control system, and the sliding assembly comprises a sliding base and a first driving unit, wherein the sliding base is connected with the first driving unit, and the sliding base is fixedly connected with the mounting base.

38. The energy-saving environment-friendly digital lettering machine according to claim 37, characterized in that the first driving unit comprises a first screw rod and a first motor, the bottom of the sliding base is provided with a nut connecting seat which is sleeved on the first screw rod, and the first screw rod is connected with the first motor.

39. The energy-saving environment-friendly digital lettering machine according to claim 6, characterized in that the sliding assembly is arranged on the working platform, the sliding assembly is electrically connected with the control system, and the sliding assembly comprises a sliding base and a first driving unit, wherein the sliding base is connected with the first driving unit, and the sliding base is fixedly connected with the mounting base.

40. The energy-saving environment-friendly digital lettering machine according to claim 39, characterized in that the first driving unit comprises a first screw rod and a first motor, the bottom of the sliding base is provided with a nut connecting seat which is sleeved on the first screw rod, and the first screw rod is connected with the first motor.

* * * * *